United States Patent [19]

Filisko et al.

[11] Patent Number: 4,879,056

[45] Date of Patent: Nov. 7, 1989

[54] ELECTRIC FIELD DEPENDENT FLUIDS

[75] Inventors: Frank E. Filisko; William F. Armstrong, both of Ann Arbor, Mich.

[73] Assignee: Board of Regents Acting for and on Behalf of University of Michigan, Ann Arbor, Mich.

[21] Appl. No.: 111,938

[22] Filed: Oct. 21, 1987

Related U.S. Application Data

[63] Continuation-in-part of Ser. No. 922,003, Oct. 22, 1986, Pat. No. 4,744,914.

[51] Int. Cl.[4] ..... H01B 3/20

[52] U.S. Cl. ..... 252/74; 252/73; 252/77; 252/78.1; 252/78.3; 252/79

[58] Field of Search ..... 252/73, 74, 77, 78.1, 252/78.3, 79

[56] References Cited

U.S. PATENT DOCUMENTS

| | | | |
|---|---|---|---|
| 3,047,507 | 7/1962 | Winslow | 252/75 |
| 3,250,726 | 5/1966 | Martinek et al. | 252/74 |
| 3,367,872 | 2/1968 | Martinek et al. | 252/74 |
| 3,984,086 | 10/1976 | Gerrish | 259/1 R |
| 4,033,892 | 7/1977 | Stangroom | 252/76 |
| 4,129,513 | 12/1978 | Stangroom | 252/73 |
| 4,342,334 | 8/1982 | Stangroom | 137/625.48 |
| 4,444,298 | 4/1984 | Stangroom | 192/21.5 |
| 4,483,788 | 11/1984 | Stangroom et al. | 252/76 |
| 4,493,615 | 1/1985 | Stangroom | 417/48 |
| 4,502,973 | 3/1985 | Stangroom | 252/73 |
| 4,687,589 | 8/1987 | Block et al. | 252/73 |

OTHER PUBLICATIONS

Electrorheological Fluids by J. E. Stangroom, Physics in Tech., vol. 14, 1983.

ER Fluid Devices Near Commercial Stage by David Scott, Automotive Engineering, Nov. 1985.

Solidifying Fluid Transforms Clutches and Flow Valves Automotive Engineering, Nov. 1983.

*Primary Examiner*—Robert A. Wax

*Attorney, Agent, or Firm*—Robert B. Stevenson

[57] ABSTRACT

An improved method of inducing a change in the dynamic torque transmission of an electrorheological fluid in response to an electric field at low current comprising the steps of: (a) selecting a nonconductive liquid phase (e.g. high dielectric hydrocarbon oil); (b) dispersing in the nonconductive liquid phase a particulate phase substantially free of adsorbed water (e.g. zeolite); and (c) subjecting the resulting electrorheological fluid to an electric potential in excess of about one kilovolt at a current density of less than about one-third microamp per square inch. Such a method achieves a rate of increase of dynamic transmission of torque per unit voltage, dM/dV, in excess of about 0.034 ft-lbs$\times 10^{-3}$/kV and a ratio of dynamic transmission of torque at an electric field strength of at least 2.4 kV to the dynamic transmission of torque at zero field strength, M/Mo, of at least about 2.

16 Claims, 46 Drawing Sheets

FIG.1

ELECTRIC FIELD DEPENDENT FLUIDS

CROSS-REFERENCE TO RELATED APPLICATIONS

This application is a continuation in part of U.S. patent application Ser. No. 922,003, filed on Oct. 22, 1986, now U.S. Pat. No. 4,744,914, issued May 17, 1988.

BACKGROUND OF THE INVENTION 1.1. Field of the Invention

This invention relates to electric field dependent/responsive fluids such as the so-called "electrorheological" or "electroviscous" fluids. More specifically, the invention relates to the use of improved electric field dependent fluids wherein the fluids exhibit a reversible rise in viscosity and a corresponding change in dynamic torque transmission in the presence of high voltage at temperatures in excess of 100° C. without the deleterious release of water.

2.2. Description of the Prior Art

It is generally known that electroviscous or electrorheological fluids exhibit pronounced changes in viscosity and resistance to shear in response to the application of an electric field. Such fluids generally comprise suspensions of finely divided, solid particles which intentionally contain a certain amount of adsorbed water dispersed in a nonconductive, hydrophobic liquid. The presence of the water has been acknowledged as being a critical and mechanistically necessary element in achieving the desired change in viscosity under the influence of an applied electric field. Thus for example, U.S. Pat. No. 3,047,507 teaches and claims the addition of excess or adsorbed water as do U.S. Pat. No. 4,483,788; 4,033,892; and 4,129,513. In explaining mechanistically the role of adsorbed water it is postulated that the presence of adsorbed water in or on the particulate material is necessary to promote ionization and thus allow charges to move freely on the surface of the particles when an electric field is imposed. However, because of the intentional presence of adsorbed water in the electroviscous fluids of the prior art, such compositions are restricted to low temperature end use applications. In high temperature applications or in high shear rate applications wherein a shear induced exotherm can occur, free water or water vapor will be produced, thus representing a potentially corrosive environment, which severely limits these prior art electroviscous fluid systems.

In a recent British patent application No. 2,170,510, an electrorheological fluid comprising a liquid continuous phase and a dispersed, substantially anhydrous phase is disclosed. Acceptable dispersed particulate phase includes semiconductor, unsaturated fused polycyclic compounds and poly(acene-quinone) polymers. However, this reference deals exclusively with electrorheological properties at static flow conditions and does not disclose the improved compositions of the present invention.

SUMMARY OF THE INVENTION

In view of the problems associated with the prior art electroviscous fluids and in particular the deleterious release of water at high temperatures and/or high shear rates, the present invention provides improved electric field dependent fluids that are operative at temperatures in excess of 100° C. without significant release of water. In this regard the electric field dependent fluids according to the present invention are to be referred to as being substantially free of adsorbed water, and as such appear to be electroviscous by virtue of a mechanism contractor at least different from that which has been previously proposed.

Thus the present invention provides a method of inducing a change in dynamic torque transmission of an electrorheological fluid in response to an electric field at low current comprising the steps of:

(a) selecting a nonconductive liquid phase;

(b) dispersing in the nonconductive liquid phase a particulate phase substantially free of adsorbed water, thus producing an electrorheological fluid; and (c) subjecting the electrorheological fluid prepared in step (b) to an electric potential in excess of about one kilovolt at a current density of less than about $\frac{1}{3}$ microamp per square inch.

It is an object of the present invention to provide electric field dependent fluids that are substantially free of adsorbed water and as such do not release deleterious amounts of water at high temperatures. It is a further object to provide a method of achieving a significant rate of increase in the dynamic transmission of torque per unit voltage and a method of maintaining a high ratio of dynamic transmission of torque at high electric field strength to dynamic transmission of torque at zero field strength. And it is an object of the present invention to provide electric field dependent fluids which will retain their electric field dependency at temperatures well above 100° C. without significant evolution of water, and which will remain functional at high shear rates. Fulfillment of these objects and the presence and fulfillment of additional objects will be apparent upon complete reading of the specification and claims taken in conjunction with the attached drawings.

DESCRIPTION OF THE PREFERRED EMBODIMENTS

Figure 1:
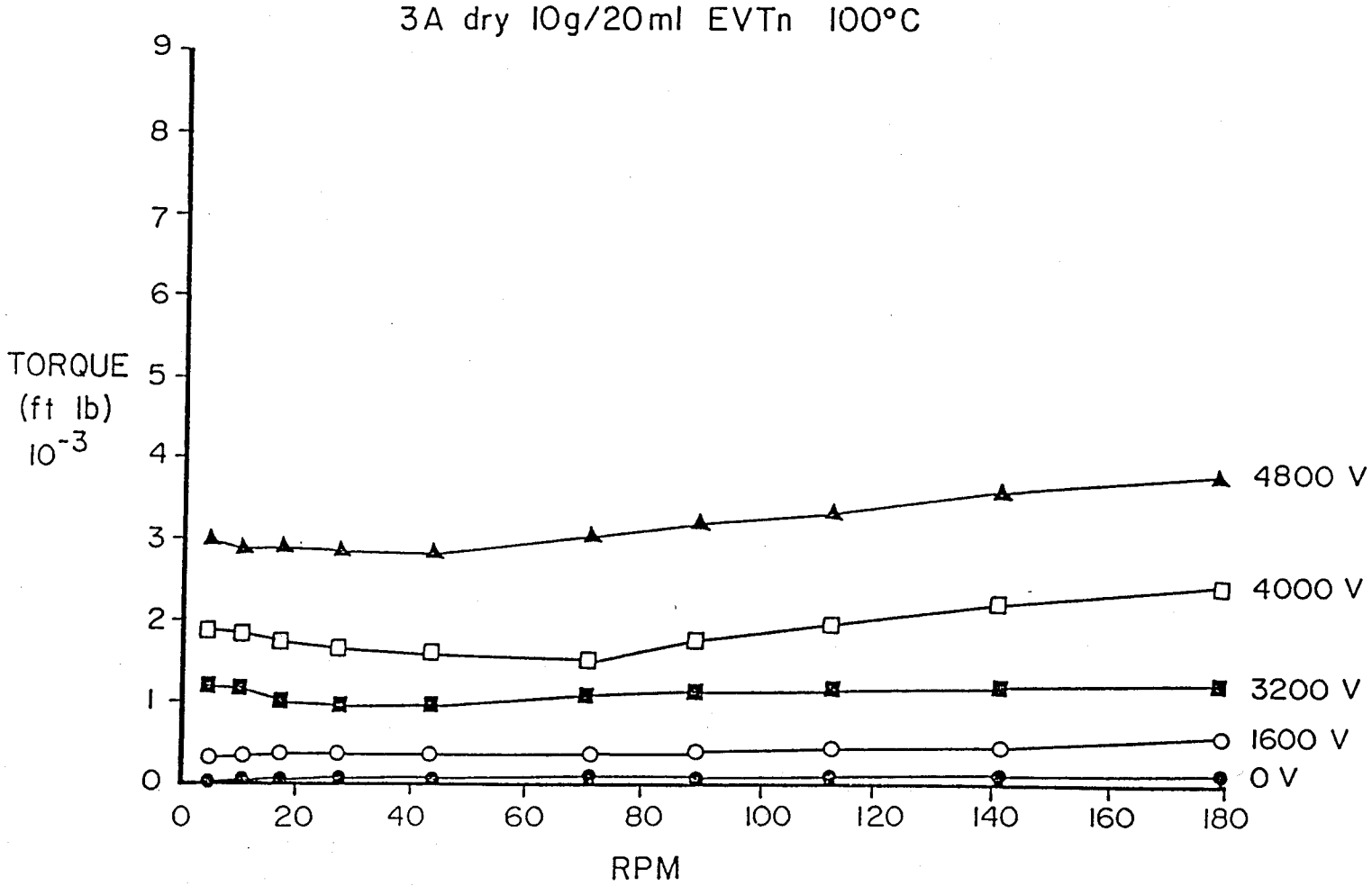
FIGS. 1 through 8 represent plots of transmitted torque as a function of rpm at various applied electric field strengths for a series of electric field dependent fluids according to the present invention.

The improved electric field dependent fluids according to the present invention are essentially two component systems in that they are comprised of a nonconductive liquid phase and a dispersed crystalline phase such as a zeolite or more specifically a crystalline aluminosilicate phase or a polyelectrolyte such as a cation or anion exchange resin which is substantially free of adsorbed water. In other words, the composition of the present invention, in contrast to the prior art compositions, involves a dispersed particulate solid phase in a nonconductive liquid wherein the dispersed particulate solid phase is intentionally dried prior to use, even though the prior art teaches that adsorbed water on the dispersed particulate phase is critical and mechanistically necessary to achieve electroviscous behavior.

The liquid phase employed in the electric field dependent fluids according to the present invention can generally be any nonconductive substance or material that exists in a liquid phase at the end use condition to which the fluid is to be employed. As such the liquid phase selected for use in the field dependent fluids according to the present invention can be solids, waxes or the like at room temperatures provided they become liquids under the operating conditions of the end use application and as such are to be considered to be within the scope of the phrase "nonconductive liquid" for purposes of this invention. Any such substance as generally known in the art can be selected as the nonconductive liquid phase including by way of example but not limited thereto: silicone fluids, greases, and waxes; various hydrocarbons, including petroleum fractions, greases, waxes, polymers, high dielectric oils, transformer oils; and similar petrochemicals or the like. The preferred liquid phase materials are the silicone fluids and/or the high dielectric hydrocarbon oils. Preferably, the selection of the liquid phase is based on low affinity for water (hydrophobicity), low viscosity and maximum dielectric strength.

The particulate phase to be dispersed in the nonconductive liquid phase according to the present invention can generally be any substance that categorically is characterized as a crystalline zeolite or resinous polyelectrolyte. As such, any composition which contains significant crystalline aluminosilicate structure is viewed as being operative for purposes of this invention. Similarly, any composition which contains a significant plurality of ionic groups distributed along a polymer chain should be viewed as being operative for purposes of this invention. The natural zeolites as well as synthetic zeolites having significant crystallinity in contrast to being amorphous, and organic polymeric polyelectrolytes, cation exchange resins or anion exchange resins will exhibit the desired high temperature electric field dependent properties of the present invention. Preferably, the particulate phase according to the present invention is to be used in a dry state or more specifically is to be substantially free of adsorbed water. Most preferably it is to be dried at a temperature equal to or in excess of the temperatures characteristic of the intended end use. In this manner the release or evolution of water during use does not take place and the deleterious effects of water (i.e., changing the dielectric strength of the system and corrosion) do not occur.

One particularly preferred system of particles which, when dispersed into any appropriate nonconductive dielectric fluid, will result in a field dependent fluid which is stable at temperatures in excess of 100° C. and at least as high as 120° C. are the crystalline aluminosilicates of the general formula:

$$M_{(x/n)}[(AlO_2)_x(SiO_2)_y]\cdot wH_2O$$

where M is a metal cation or mixture of metal cations of average valence charge n, x and y are integers and the ratio of y to x is from about 1 to about 5, and w is a variable.

The effectiveness of these particles in field dependent fluids varies with the type or types and amounts of cations, and more specifically the relative amounts of Si and Al, and their structures. These particles have enormous surface areas due to a unique porous nature which consists of various cavities interconnected by channels. The size of the cavities and channels is controllable synthetically and very important to the effectiveness of the particles. As such, these particles are previously known as molecular sieves and as chemically specific catalyst supports. However, these prior art uses appear to be based mechanistically on the pore size of the molecular sieve which by itself cannot explain the extraordinary field dependent properties of the present invention. Similarly, the adsorbed water mechanism proposed in the prior art associated with the particles of the previously known field dependent fluids cannot, in principle, explain the phenomenon discovered in the present invention. Because the adsorbed water in the molecular sieve compositions is known to be readily removable, presumably the drying of the particulate phase according to the present invention results in a system substantially free of adsorbed water (consistent with the lack of evolution of water at high temperatures and high shear).

Although the mechanism of the electric field dependent fluids according to the present invention is not known for certain and as such the present invention should not be viewed as being unduly limited relative to any one explanation or rationalization and although there may be some residual water content in the particle phase as explicitly acknowledged in the above formula (1), there is still another possible explanation for what is occurring mechanistically in the use of crystalline zeolites substantially free of adsorbed water. As previously mentioned, the properties of molecular sieves of the above formula (1) are dependent on the relative amount of aluminum incorporated into the crystal lattice. For each aluminum incorporated into the lattice, an additional negative charge is introduced requiring the presence of a metal cation associated with the crystalline structure to preserve electrical neutrality. Thus the cations of the crystalline aluminosilicate structure are not linked (covalently bonded) into the crystal structure but are instead somewhat free to migrate about the surface specifically under the influence of an electric field. Again, without unduly limiting the present invention, it is felt that the present invention represents the discovery of a totally different, unique and unexpected mechanism for achieving electric field dependent properties for particles dispersed in dielectric liquids. Most importantly, these materials retain their field dependent properties over a broad range of temperatures starting from below freezing, 0° C., to well above 100° C. and even after being stored at 250° C. for months. This allows the fluids to be used in high shear applications where large amounts of heat may be generated due to shear heating and in applications where such fluids may be exposed to high temperatures, as well as in cold environments and winter.

In order to ensure the lack of significant evolution and release of water at high temperatures and high shear rates, the electric field dependent fluids according to the present invention should be dried or otherwise maintained in an essentially water free or at least low water state. Preferably, this is accomplished by drying and degassing the electric field dependent fluid, or the selected liquid phase and particulate crystalline zeolite phase used to prepare the fluid. This drying and/or degassing can be accomplished by any method generally known and used in the art for such purposes. This would include by way of example, but is not limited to: heating, heating in a vacuum, desiccating, desiccating in a vacuum or the like. Preferably the drying and degassing of the fluids or individual phases making up the fluids are accomplished by heating the fluids under vacuum to a temperature in excess of the anticipated end use temperature, thus removing water and water vapor in both phases of the fluid. Optionally the liquid phase can be dried by direct contact with a desiccant. Preferably when drying the particulate crystalline zeolite phase, the solid is maintained at an elevated temperature, with or without vacuum, for a substantial period of time. Preferably the temperature employed is well above 100° C., such as 250° C. up to 350 ° C. or even height provided the particular crystalline structure is stable and does not collapse at the high temperature. Storage of the particulate solid phase at about 250° C. for sustained periods of time (e.g. months) is usually quite effective in maintaining the desired low water content in the crystalline zeolite structure without deleteriously affecting the electric field dependent properties. Preferably, when drying the individual phases separately, the particulate phase, after drying, is immediately dispersed in the dried liquid phase.

In order to demonstrate and confirm the desired electric field dependent properties of the fluids according to the present invention, the transmitted torque as a function of rpm was measured and recorded using a Weisenberg Rheogoniometer. The measurements were made at high temperatures (e.g. 100° C. and 250° C.), under high shear rate conditions (e.g. up to 225 rpm) at various applied electric field strengths (up to 5600 volts d.c.) for a series of selected fluids. In each case, the torque transmitted to a stationary cylindrical bob, having a one inch diameter that was concentrically surrounded by a revolving cylindrical cup having a one inch height and 0.050 inch annular spacing between the cup and bob, was measured while the rpm of the revolving cup was varied. Using the cup and the bob as electrodes, various d.c. electrical potentials were imposed across the spacing between the cup and bob, which was occupied by the selected electric field dependent fluid prepared according to the present invention.

Figure 2:
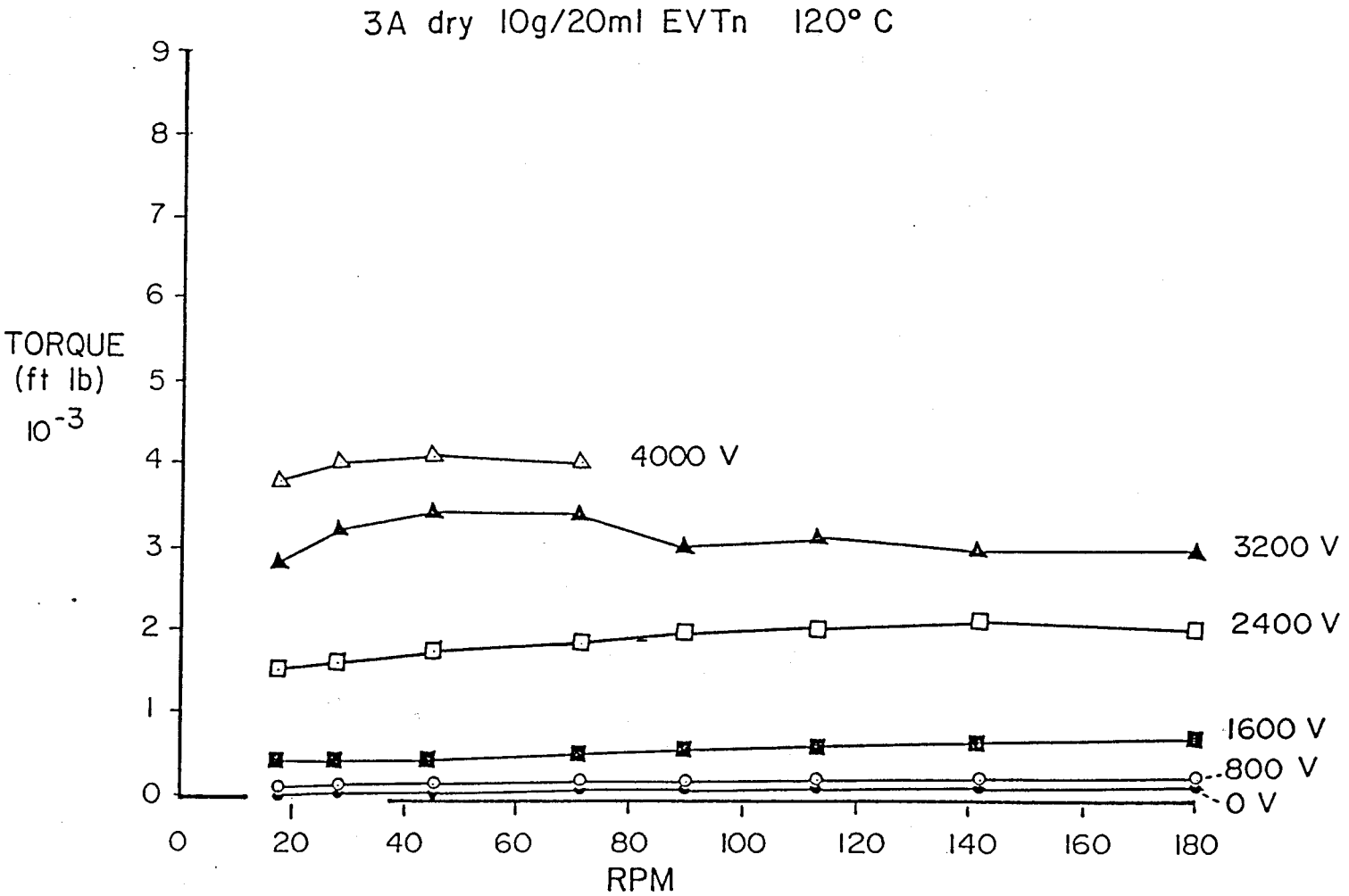
Figure 3:
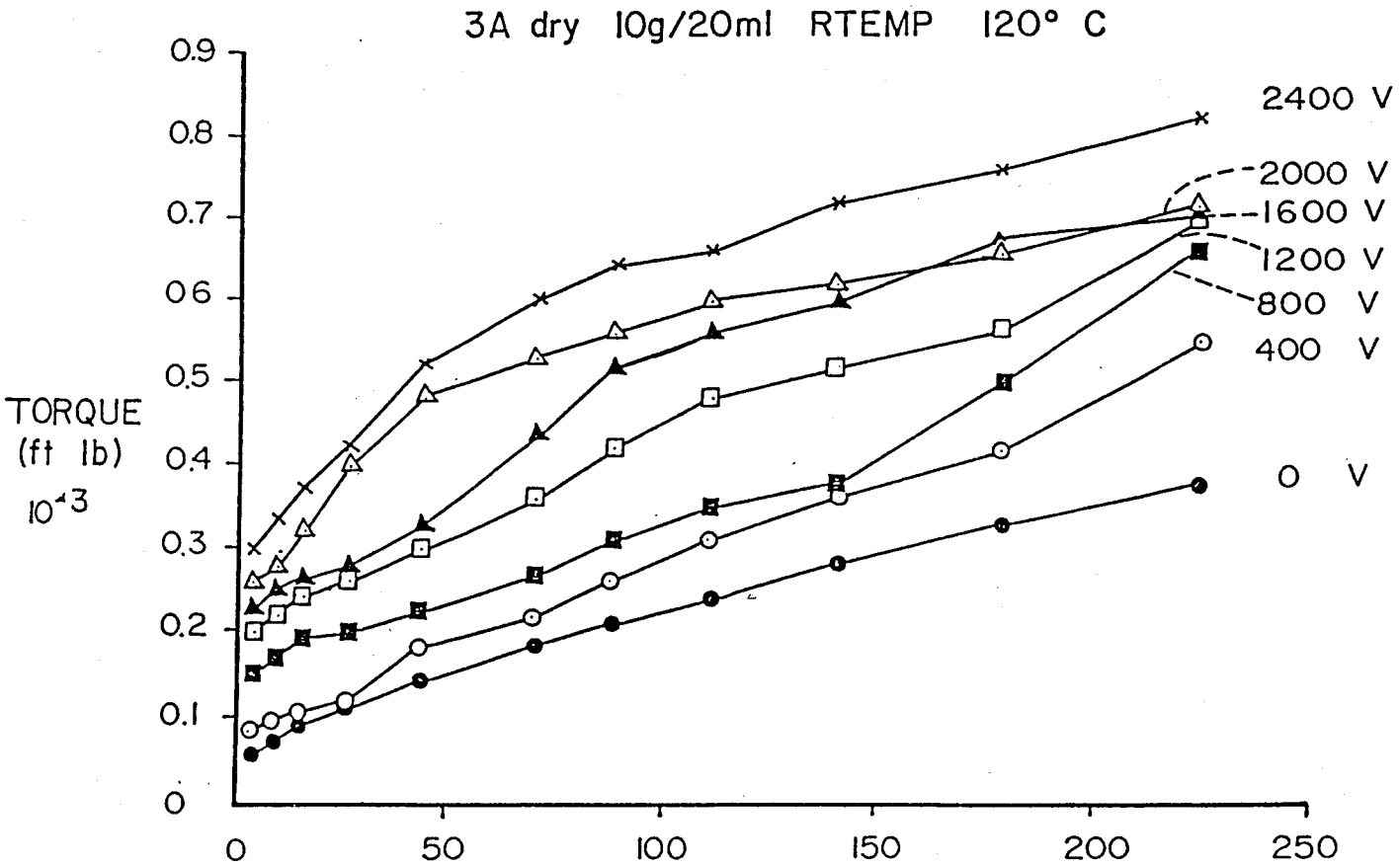
Figure 4:
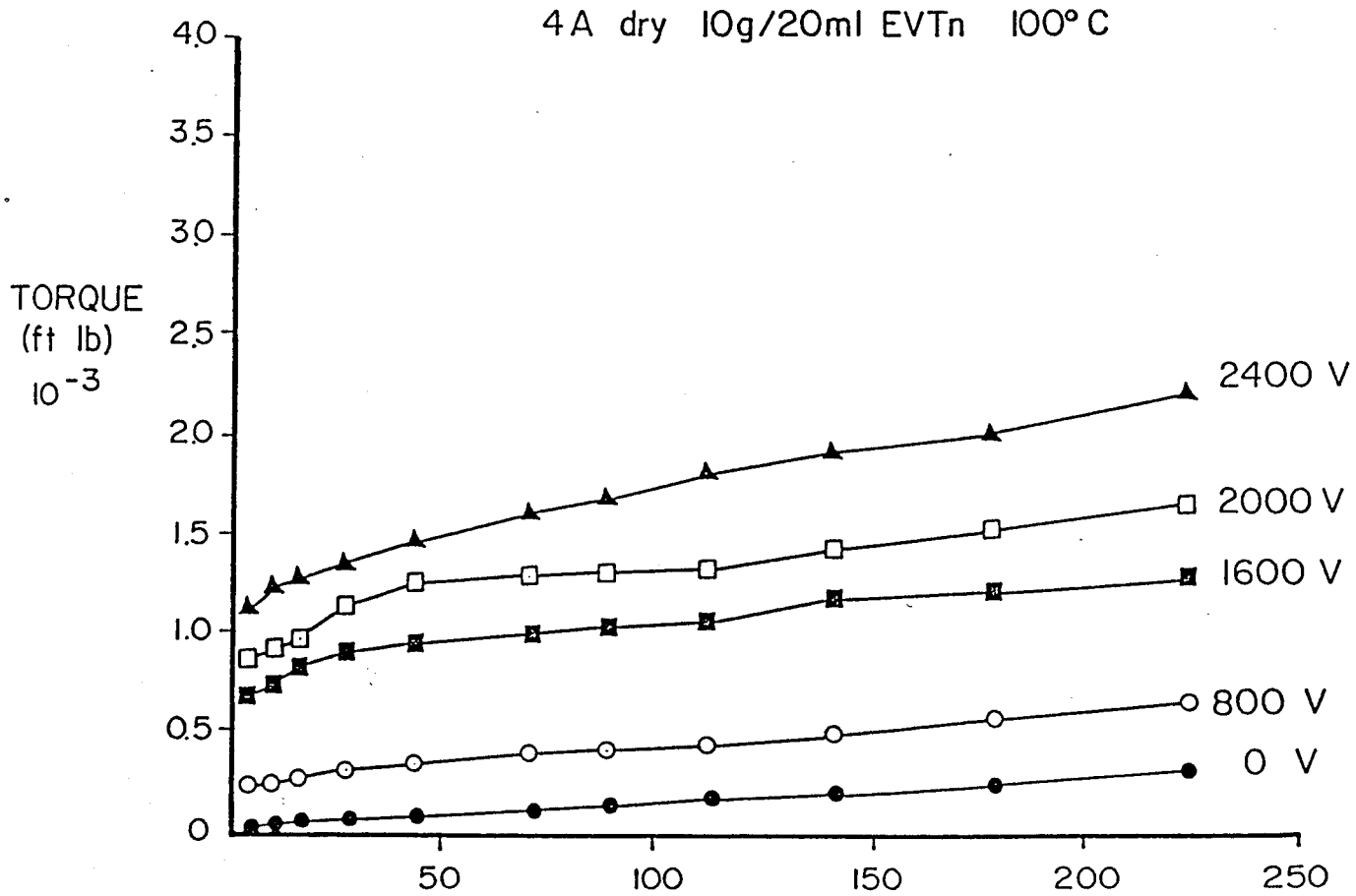
Figure 5:
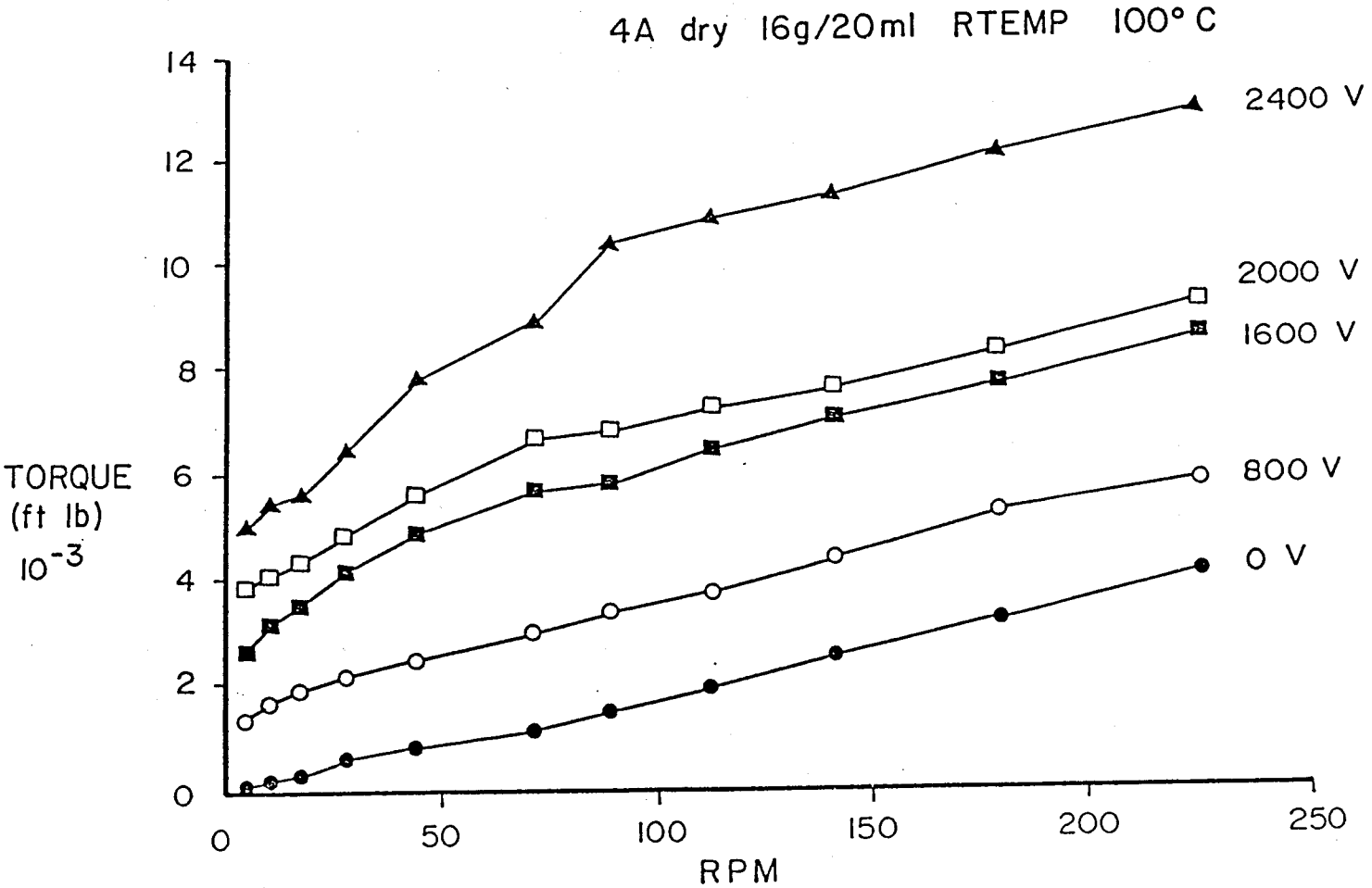
Figure 6:
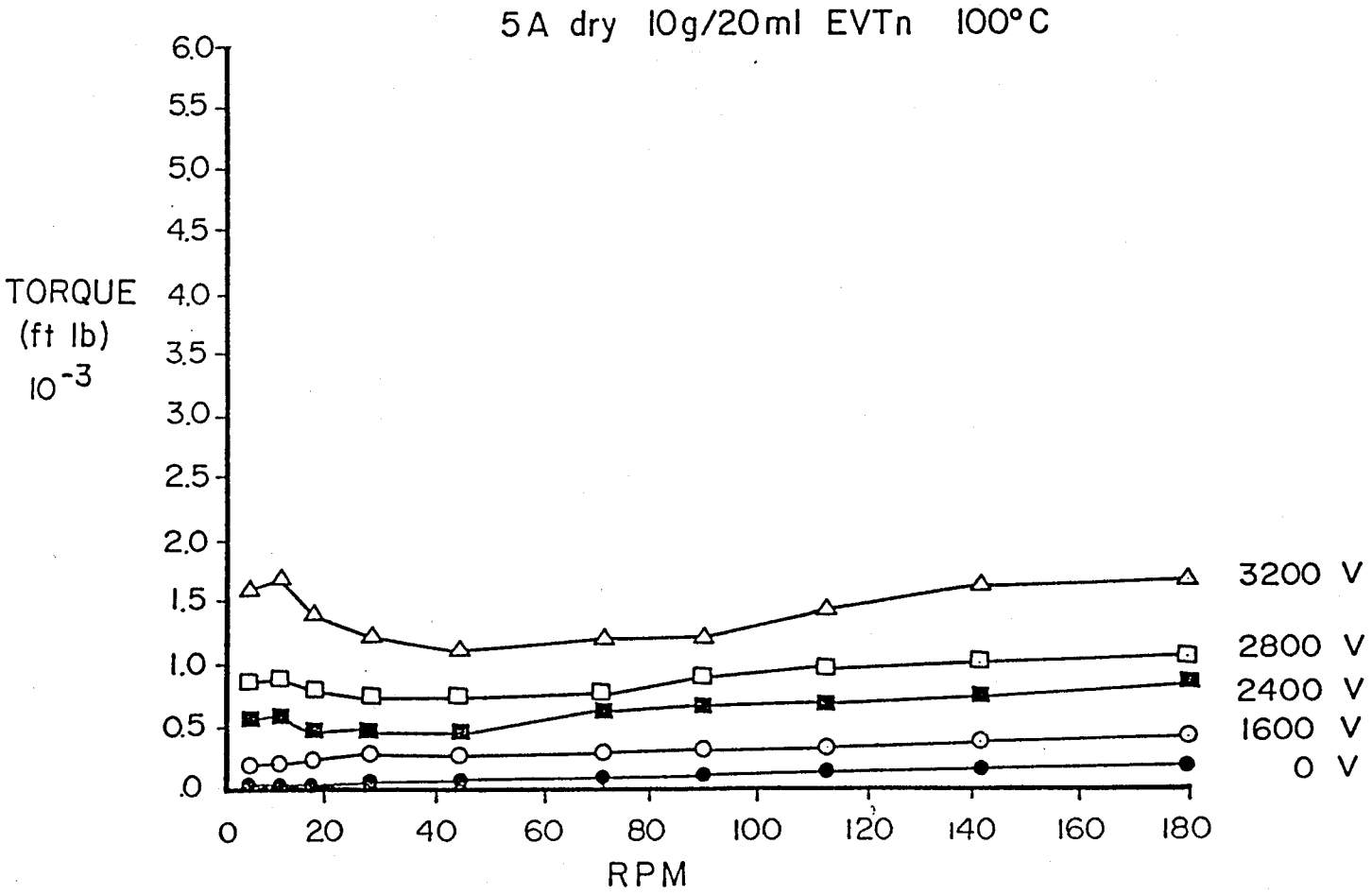
Figure 7:
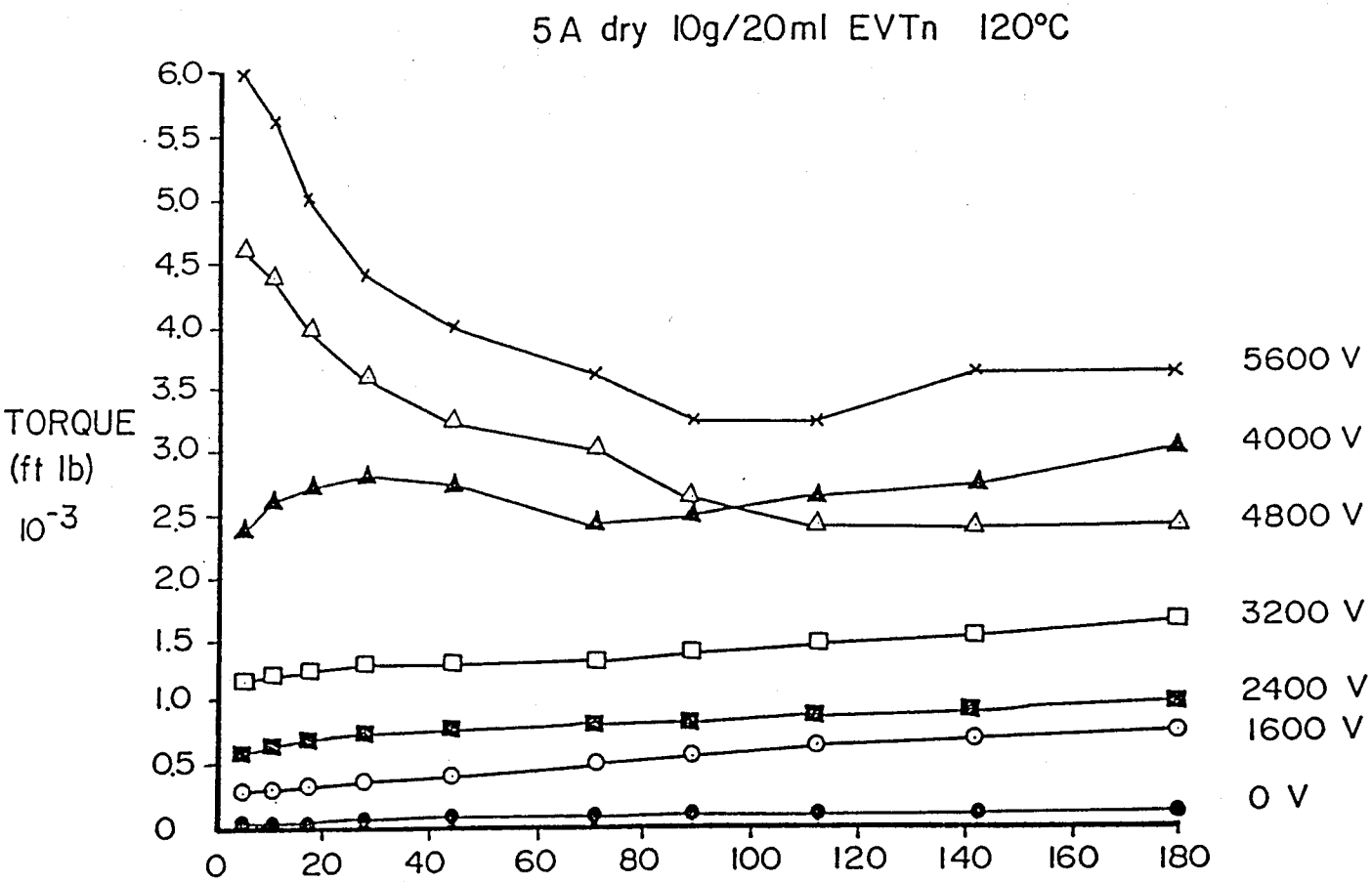
Figure 8:
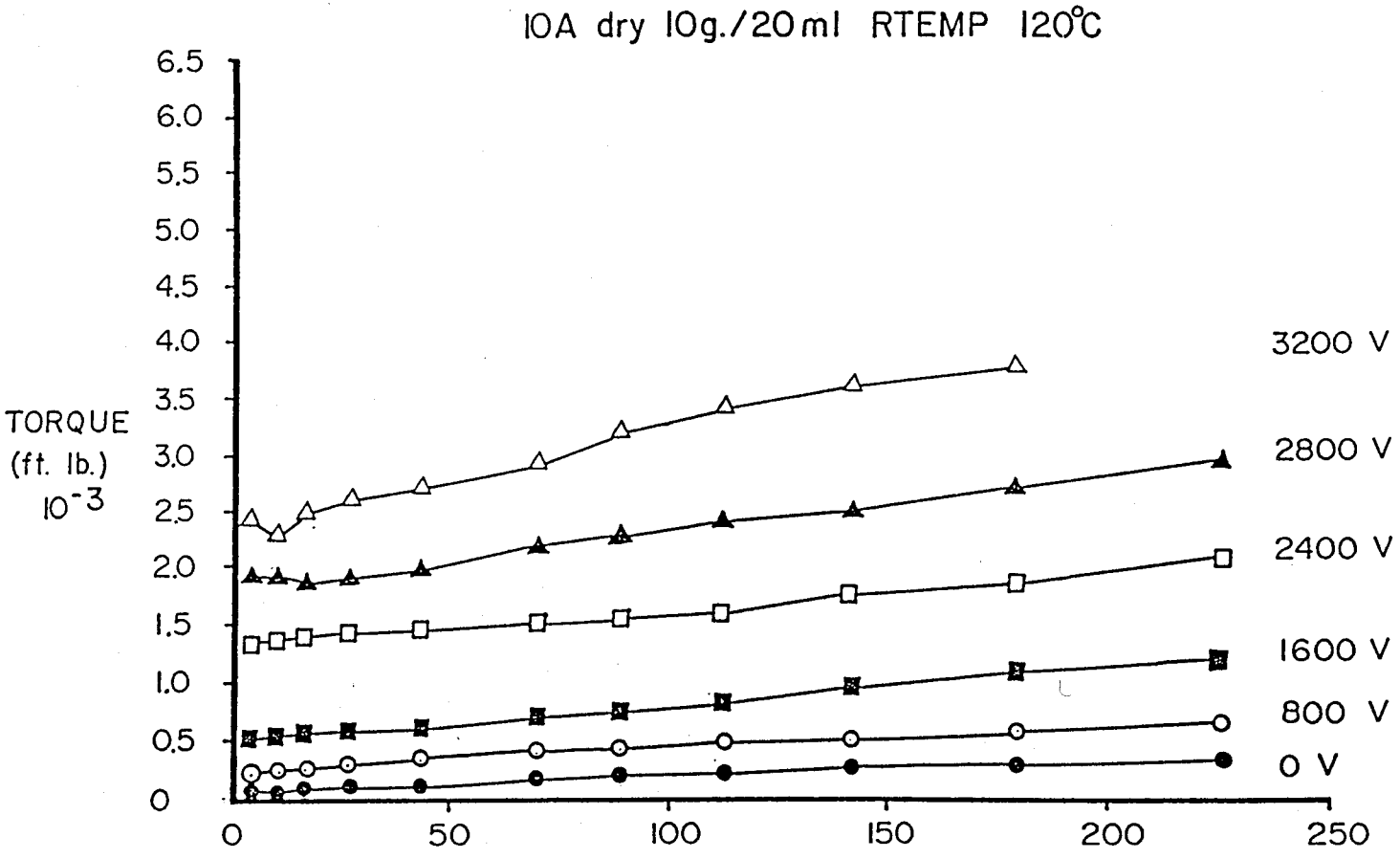

The following Examples I through VIII summarize the details of the individual fluids being measured and the conditions under which the measurements were performed. The corresponding FIGS. 1 through 8 present the resulting data for the respective examples as plots of measured or observed torque as a function of rpm at various applied electric field strengths.

EXAMPLE I

| | |
|---|---|
| Particulate Phase: | potassium sodium aluminosilicate supplied by Sigma Chemicals, nominal pore diameter 3Å; particle diameter <10μ; nominal starting water capacity 23% by weight; characterized by the formula: $K_9Na_3[(AlO_2)_{12}(SiO_2)_{12}].27H_2O$ (dried at 250° C. for a sustained period of time) |
| Liquid Phase: | high dielectric hydrocarbon oil supplied by RTE Corp. under the tradename ENVIROTEMP (EVTn) |
| Concentration | 10 grams of dried particulate phase per 20 ml of liquid phase. |
| Temperature: | 100° C. |

EXAMPLE II

| | |
|---|---|
| Particulate Phase: | same as Example I. |
| Liquid Phase: | same as Example I. |
| Concentration: | same as Example I. |
| Temperature: | 120° C. |

EXAMPLE III

| | |
|---|---|
| Particulate Phase: | same as Example I. |
| Liquid Phase: | high dielectric hydrocarbon oil supplied by RTE Corp. under the tradename RTEMP. |
| Concentration: | same as Example I. |
| Temperature: | 120° C. |

EXAMPLE IV

| | |
|---|---|
| Particulate Phase: | sodium aluminosilicate supplied by Sigma Chemicals, nominal pore diameter 4Å; particle diameter <10μ; nominal starting water capacity 23% by weight. |
| Liquid Phase: | same as Example I. |
| Concentration: | same as Example I. |
| Temperature: | 100° C. |

EXAMPLE V

| | |
|---|---|
| Particulate Phase: | same as Example IV. |
| Liquid Phase: | same as Example III. |
| Concentration: | 16 grams dried particulate phase per 20 ml of liquid phase. |
| Temperature: | 100° C. |

EXAMPLE VI

| | |
|---|---|
| Particulate Phase: | calcium sodium aluminosilicate supplied by Sigma Chemicals, nominal pore diameter 5Å; particle diameter <10μ; nominal starting water capacity 23% by weight; characterized by the formula: $Ca_{4.5}Na_3[(AlO_2)_{12}(SiO_2)_{12}].30H_2O$ (dried at 250° C. for a sustained period of time). |
| Liquid Phase: | same as Example I |
| Concentration: | same as Example I. |
| Temperature: | 100° C. |

EXAMPLE VII

| | |
|---|---|
| Particulate Phase: | same as Example VI. |
| Liquid Phase: | same as Example I. |
| Concentration: | same as Example I. |
| Temperature: | 100° C. |

EXAMPLE VIII

| | |
|---|---|
| Particulate Phase: | sodium aluminosilicate supplied by Sigma Chemicals, nominal pore diameter 10Å; particle diameter <10μ; nominal starting water capacity approximately 34% by weight; characterized by the formula: $Na_{86}[(AlO_2)_{86}(SiO_2)_{106}].264H_2O$ dried at 250° C. for a sustained period of time). |
| Liquid Phase: | same as Example III. |
| Concentration: | same as Example I. |
| Temperature: | 120° C. |

As can be seen in FIGS. 1 through 8, all of the above examples exhibit the desired electric field dependency (i.e., significant apparent viscosity in the presence of an electric field) at temperatures of 100° C. and higher even at high shear rate conditions. As such, the data confirm the efficacy of the compositions according to the present invention. Further, no significant release or evolution of water was observed and the viscosities immediately drop upon cessation of the applied electric field. Similar high temperature electroviscous properties have been observed and measured under low shear conditions for systems similar to the above examples, including silicone oils and high dielectric hydrocarbon oils as the liquid phase.

Figure 9:
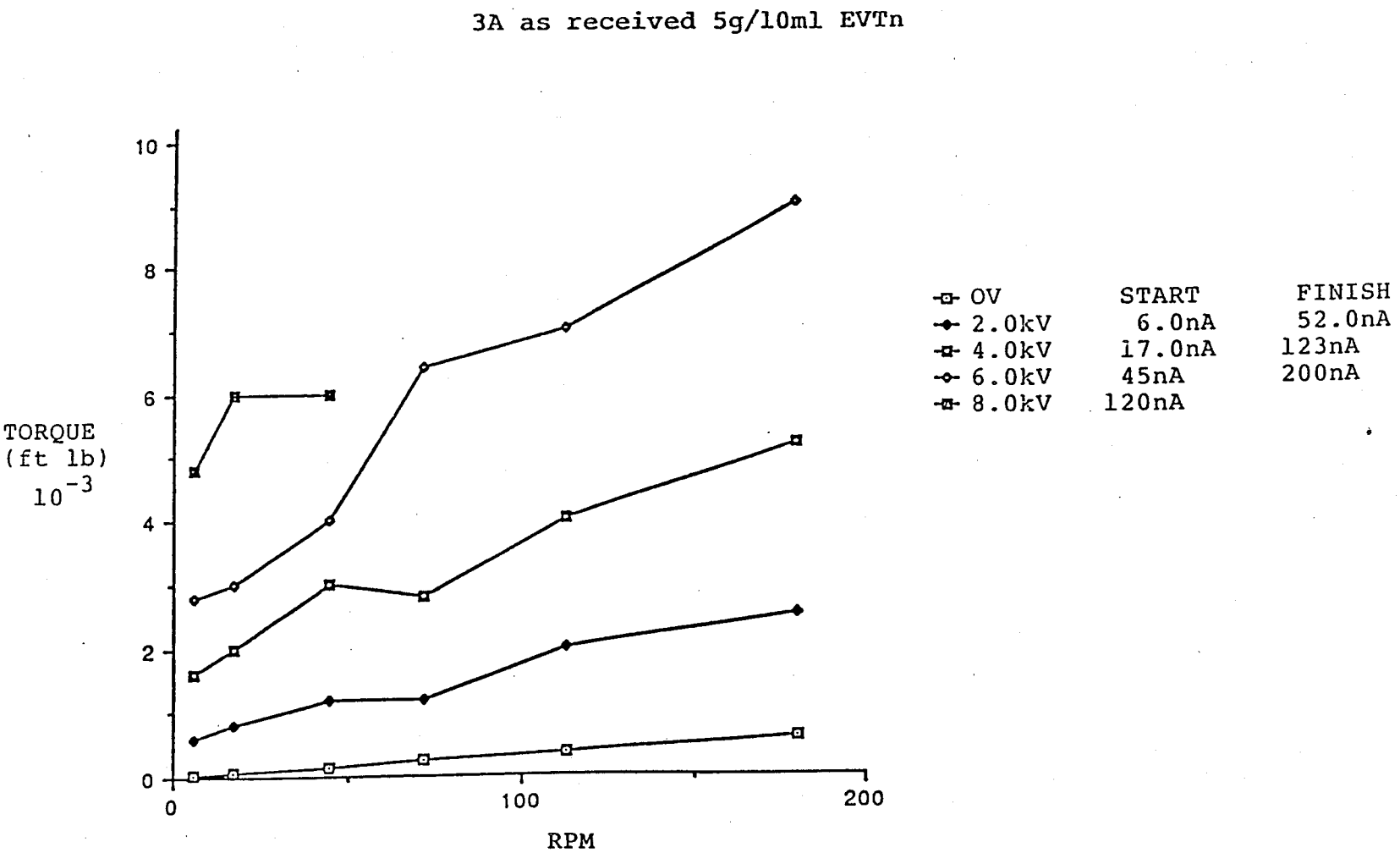
FIGS. 9 through 46 represent plots of transmitted torque as a function of rpm at various applied electric field strengths and measured electrical current for a series of electric field dependent fluids according to the present invention.
Figure 10:
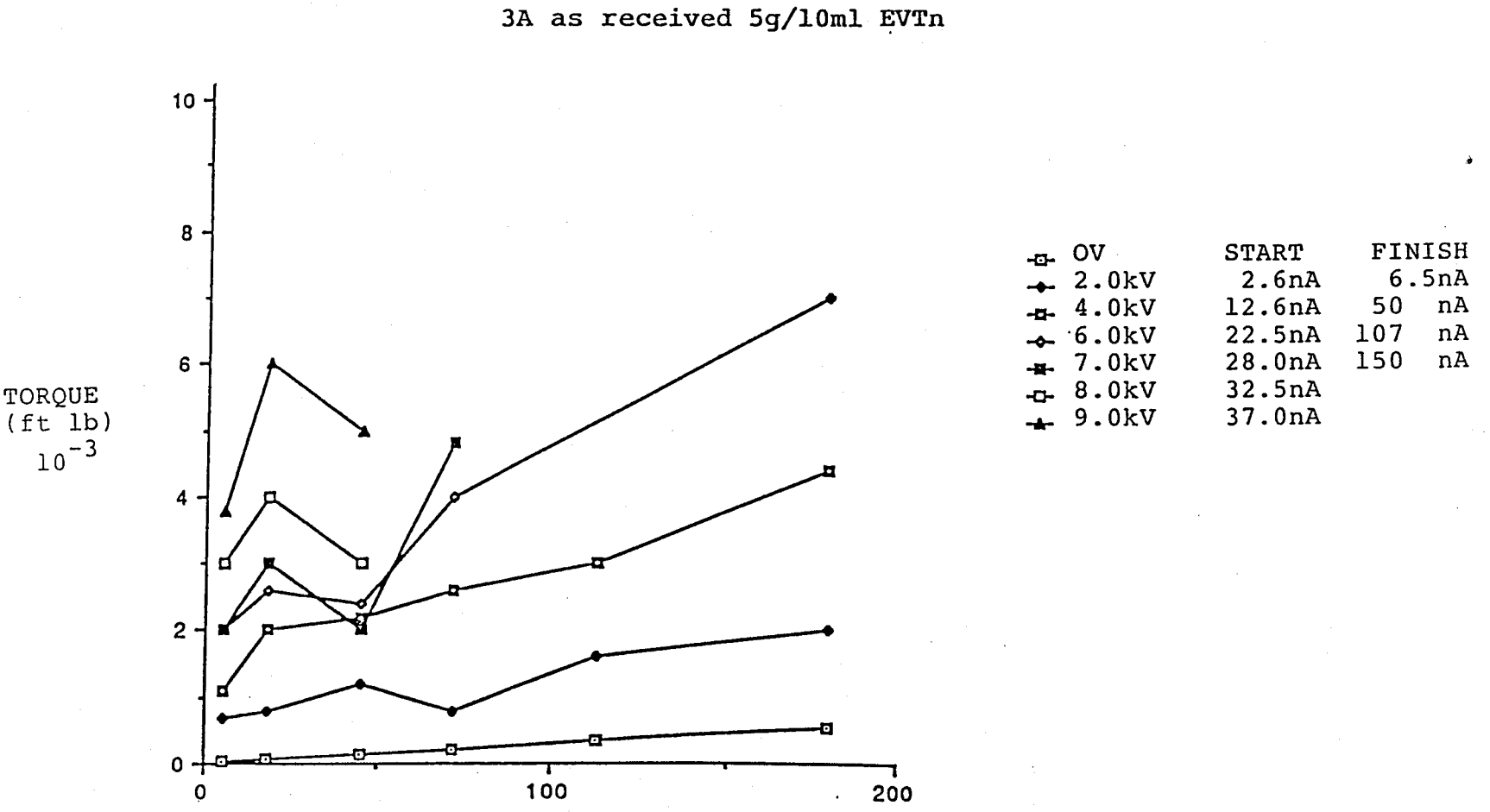
Figure 11:
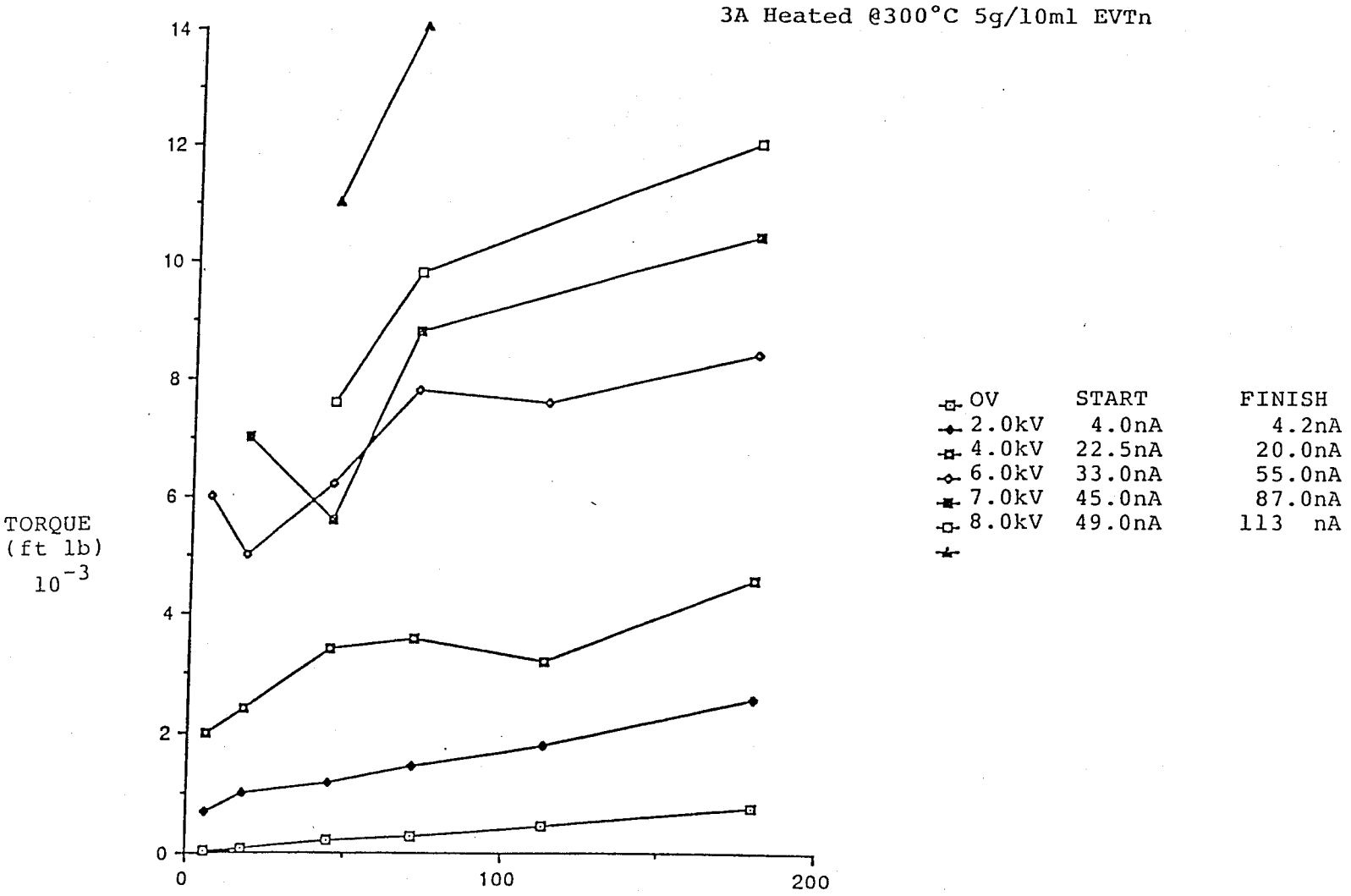
Figure 12:
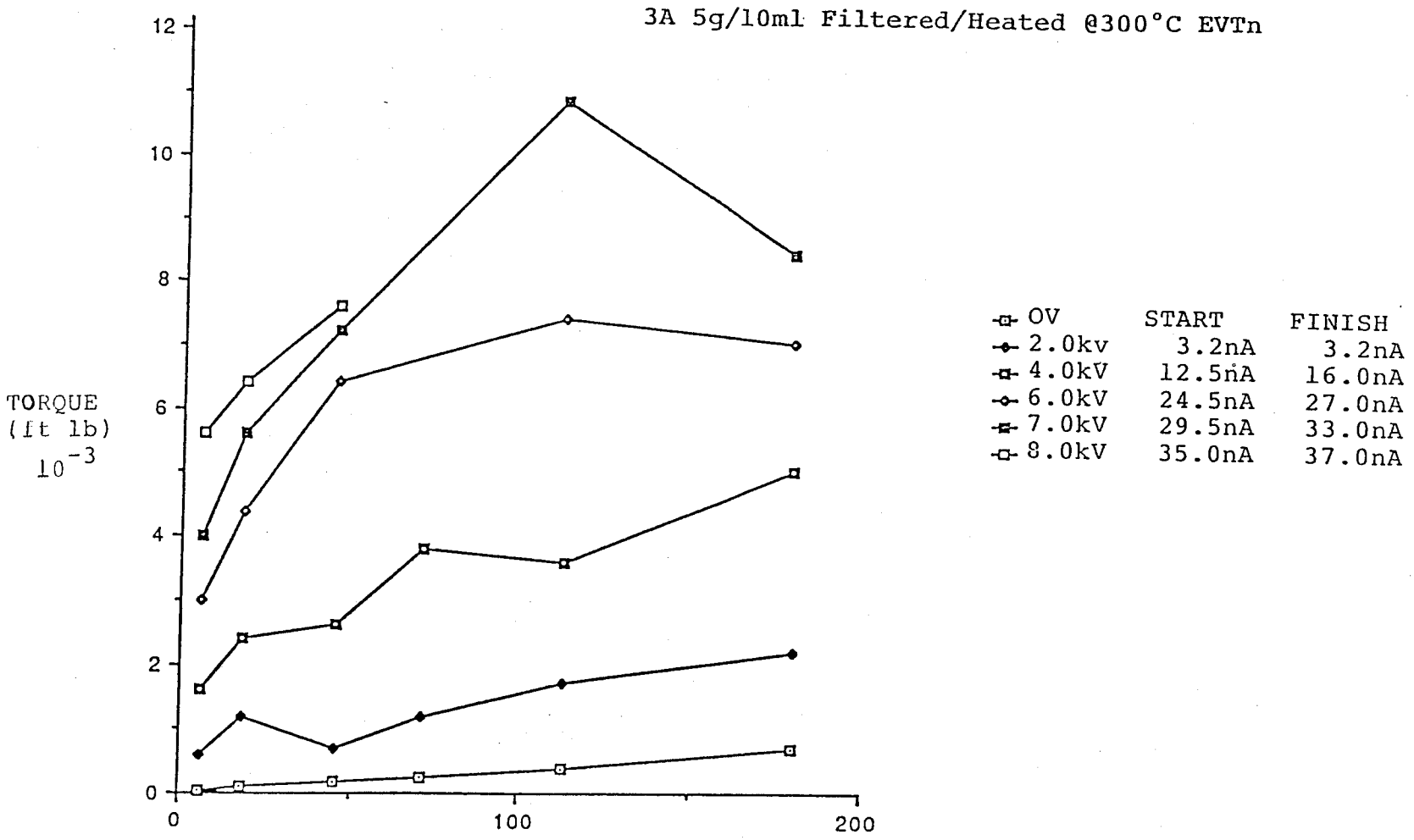
Figure 13:
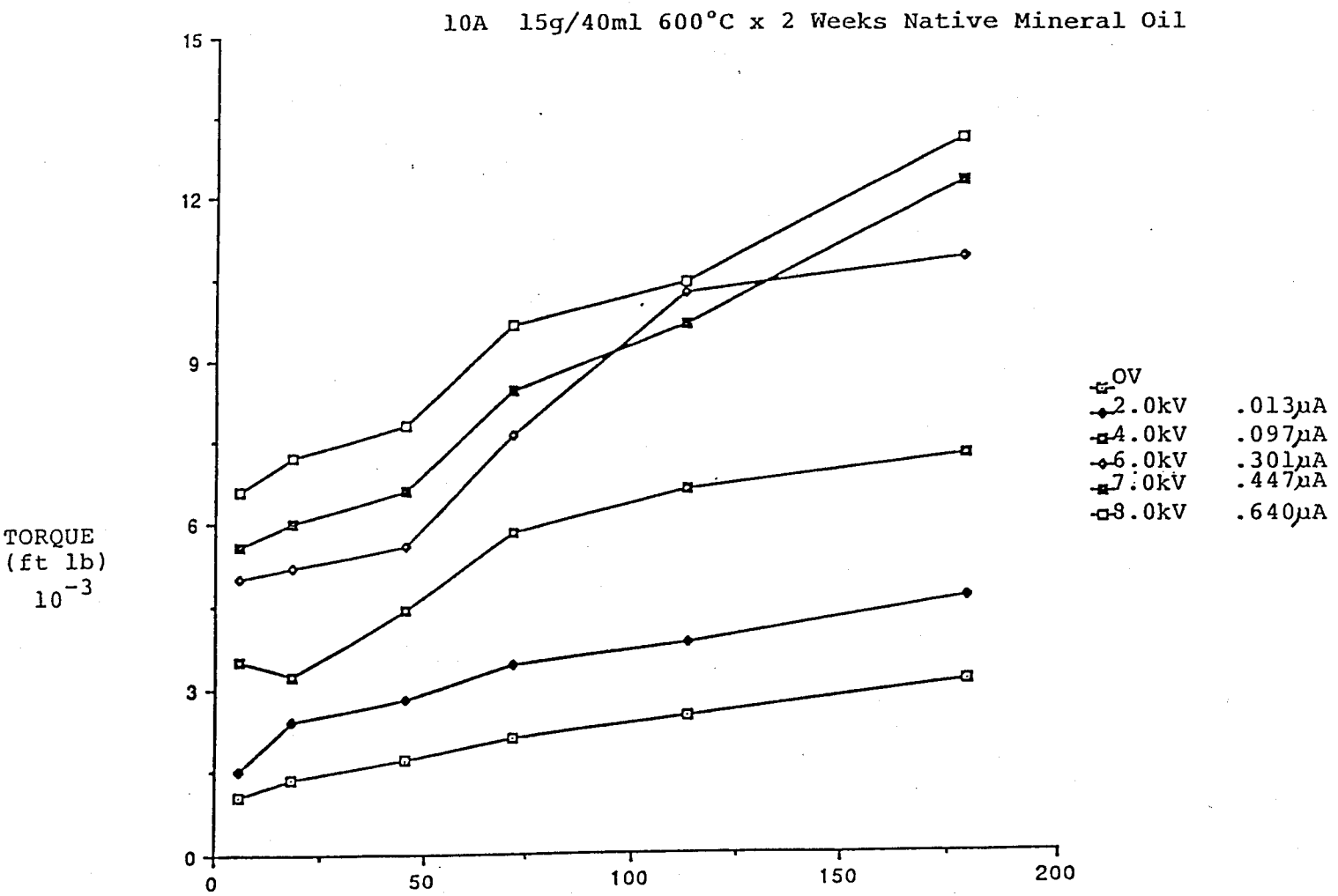
Figure 14:
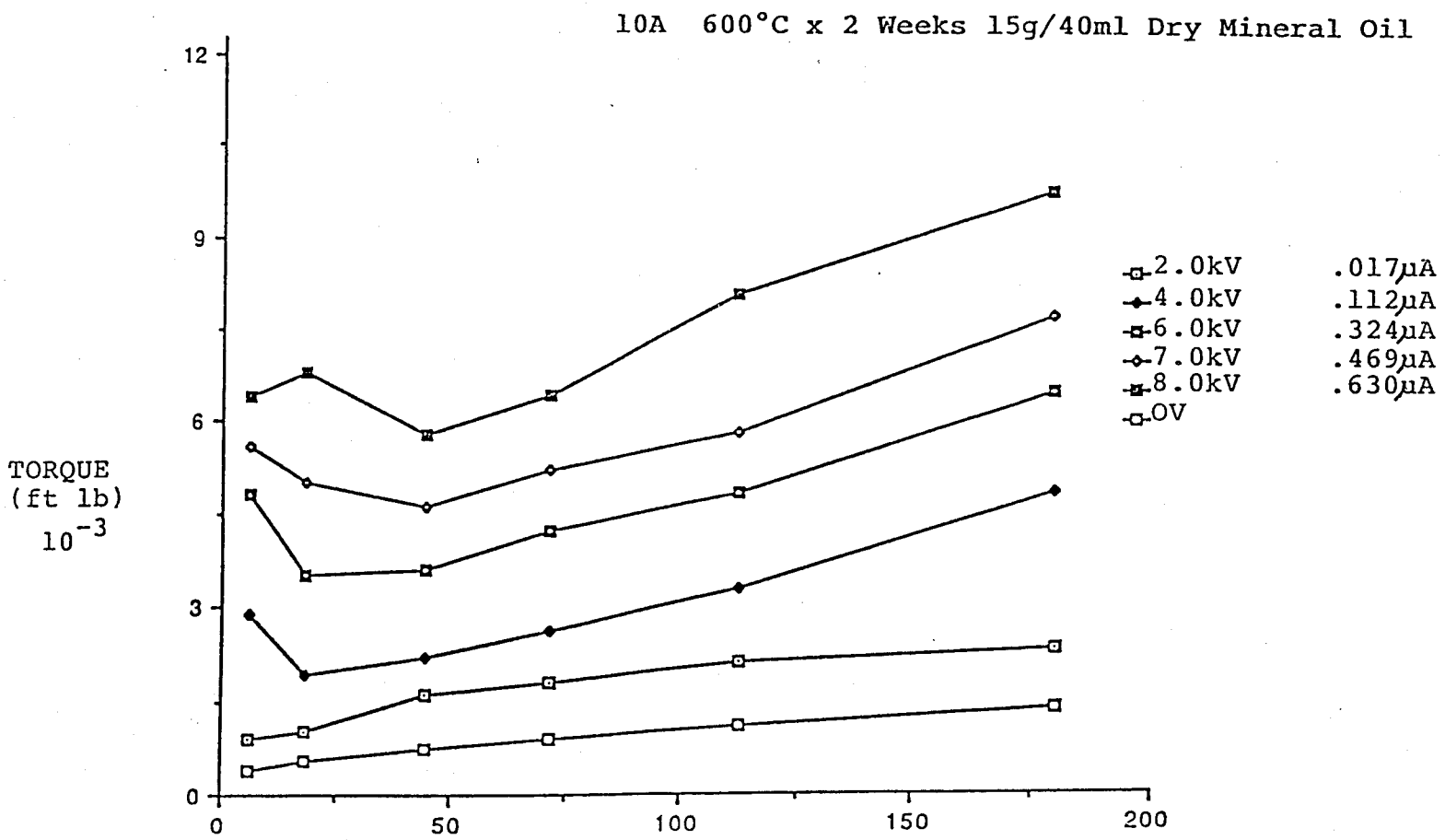
Figure 15:
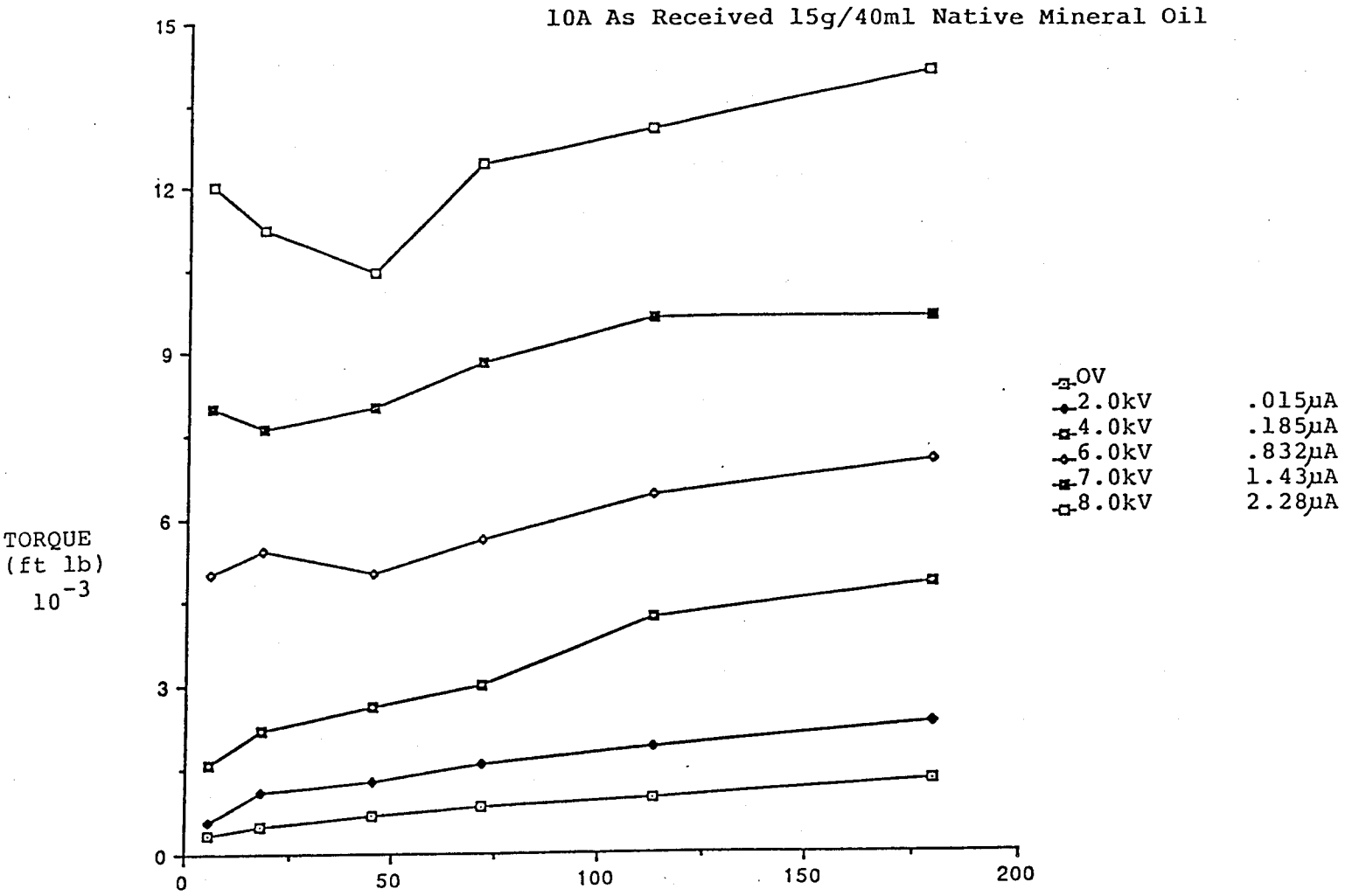
Figure 16:
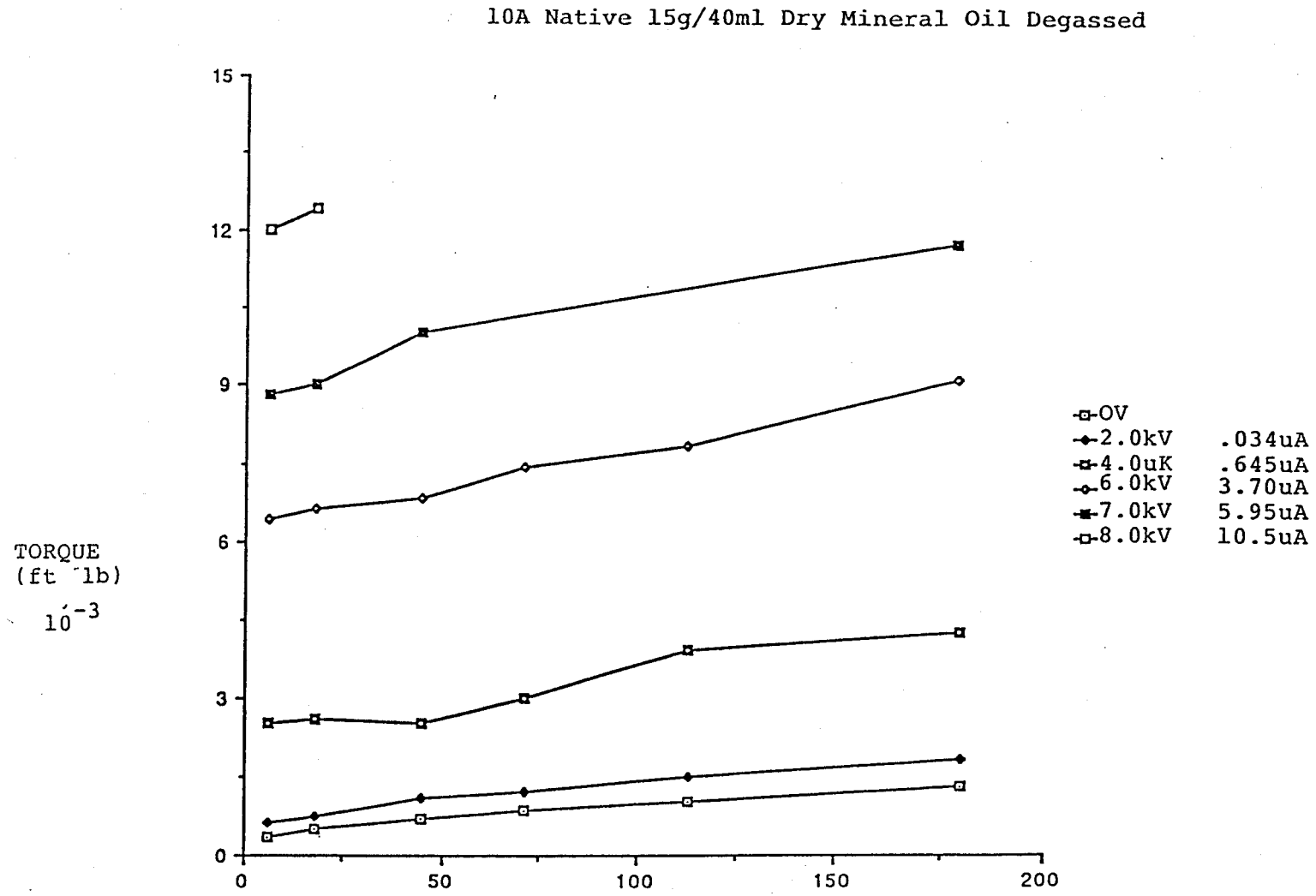
Figure 17:
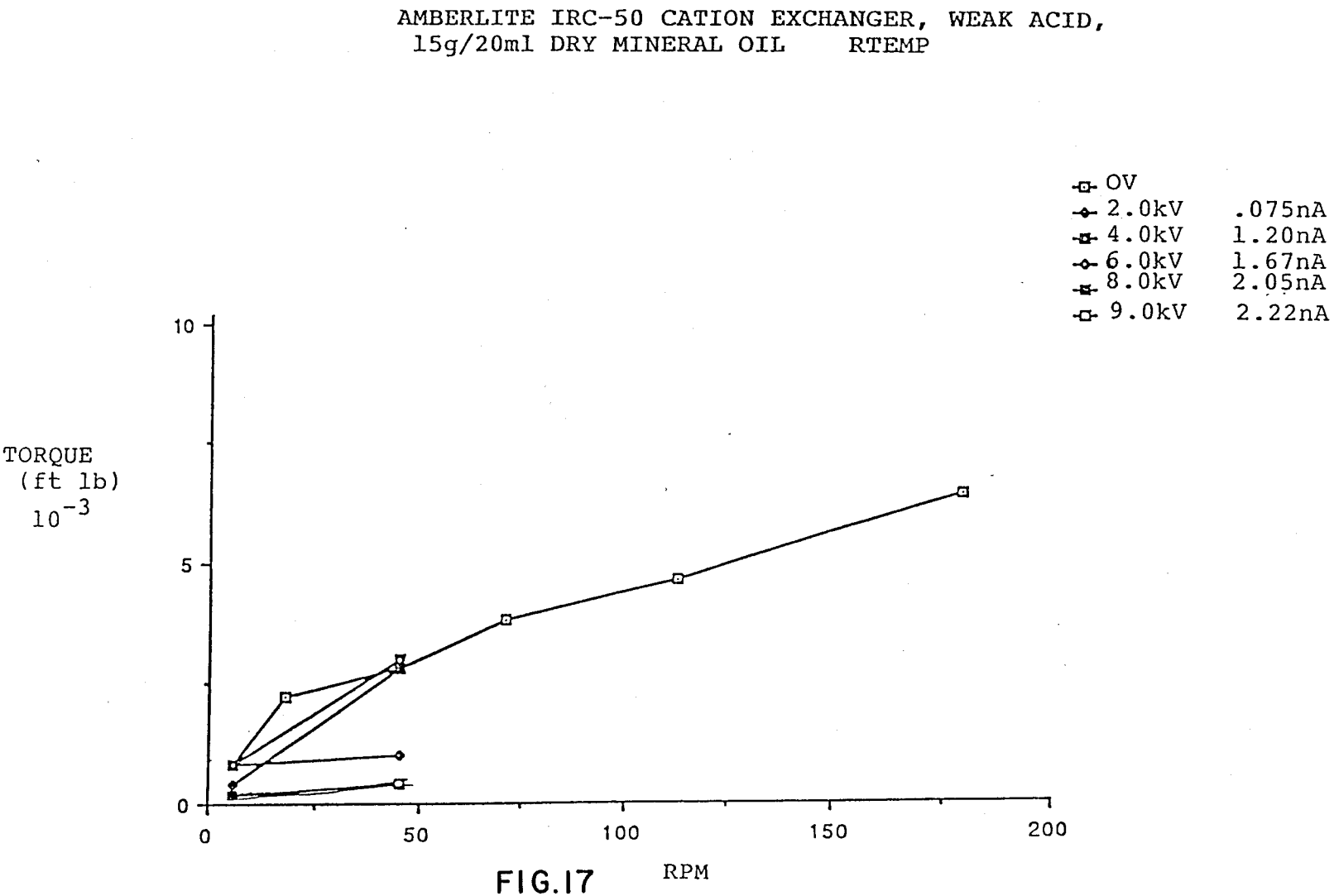
Figure 18:
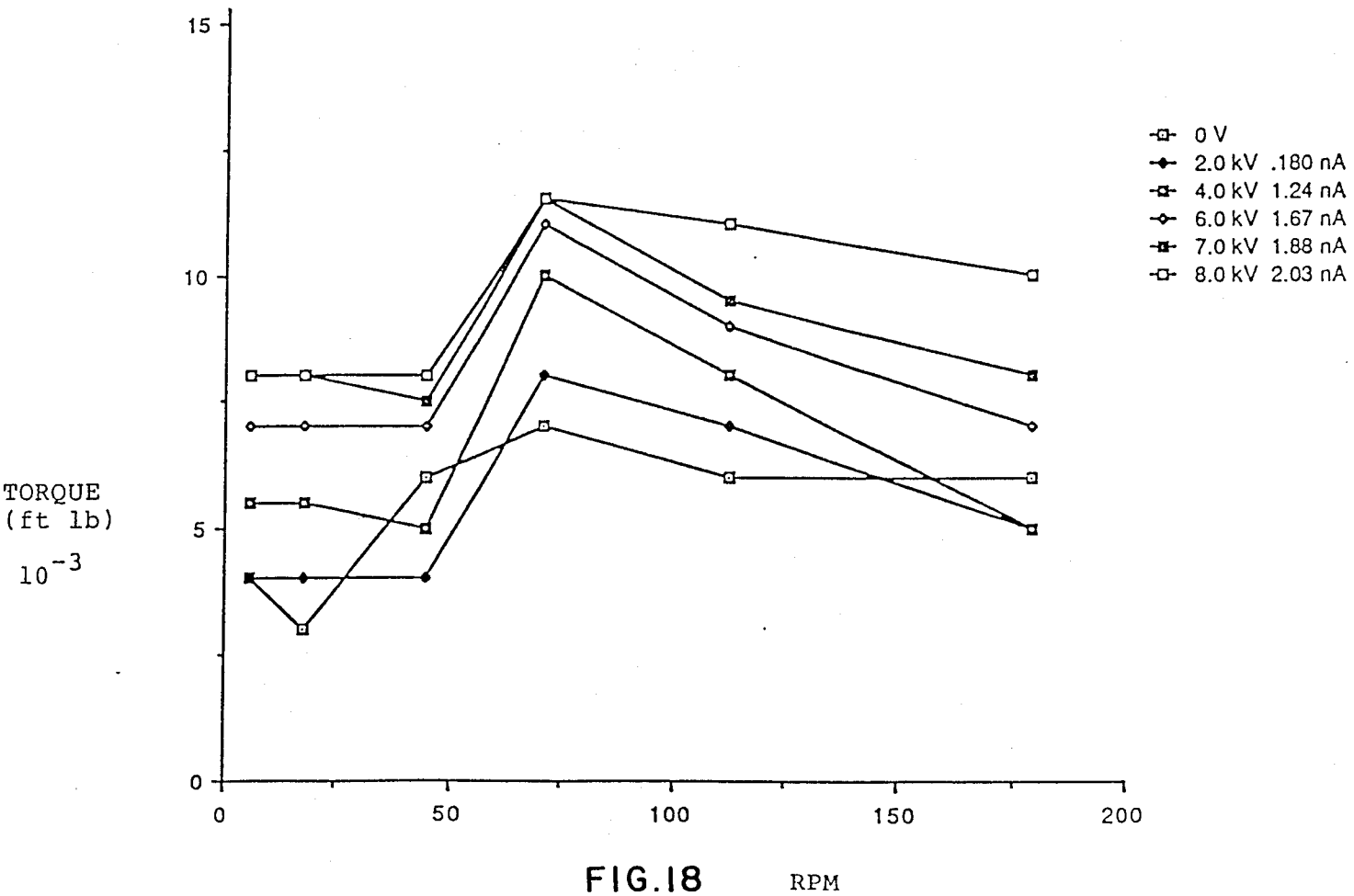
Figure 19:
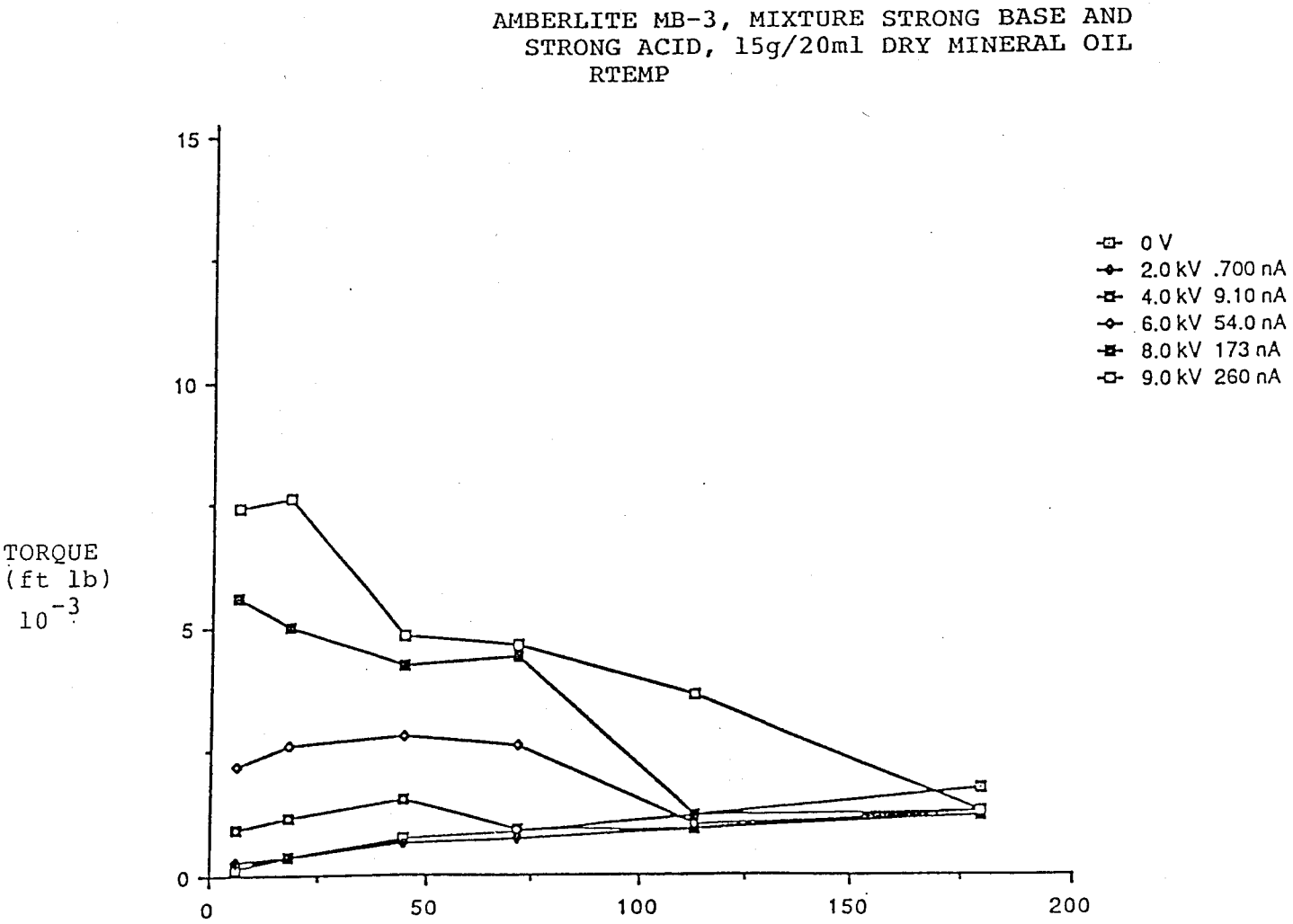
Figure 20:
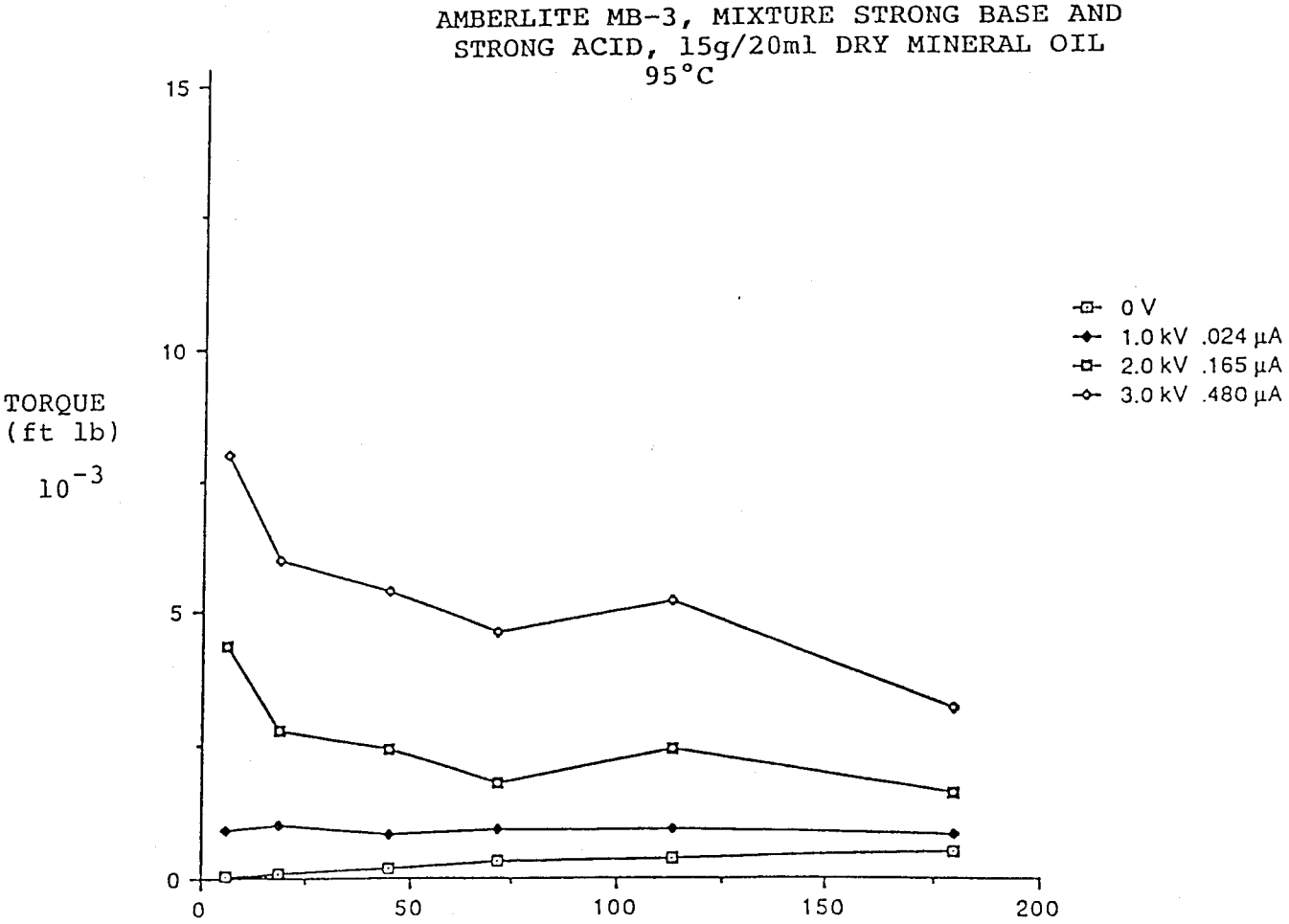
Figure 21:
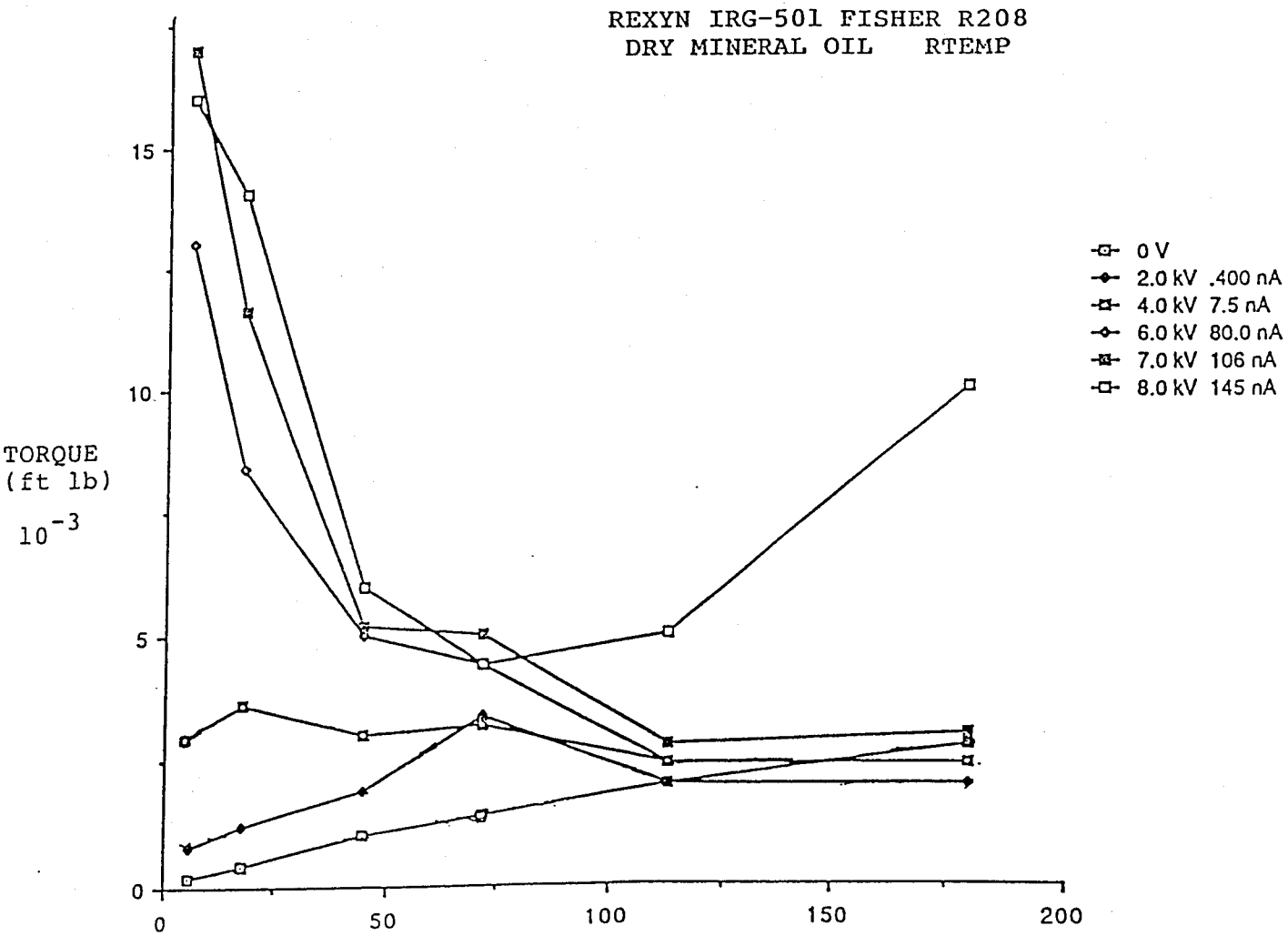
Figure 22:
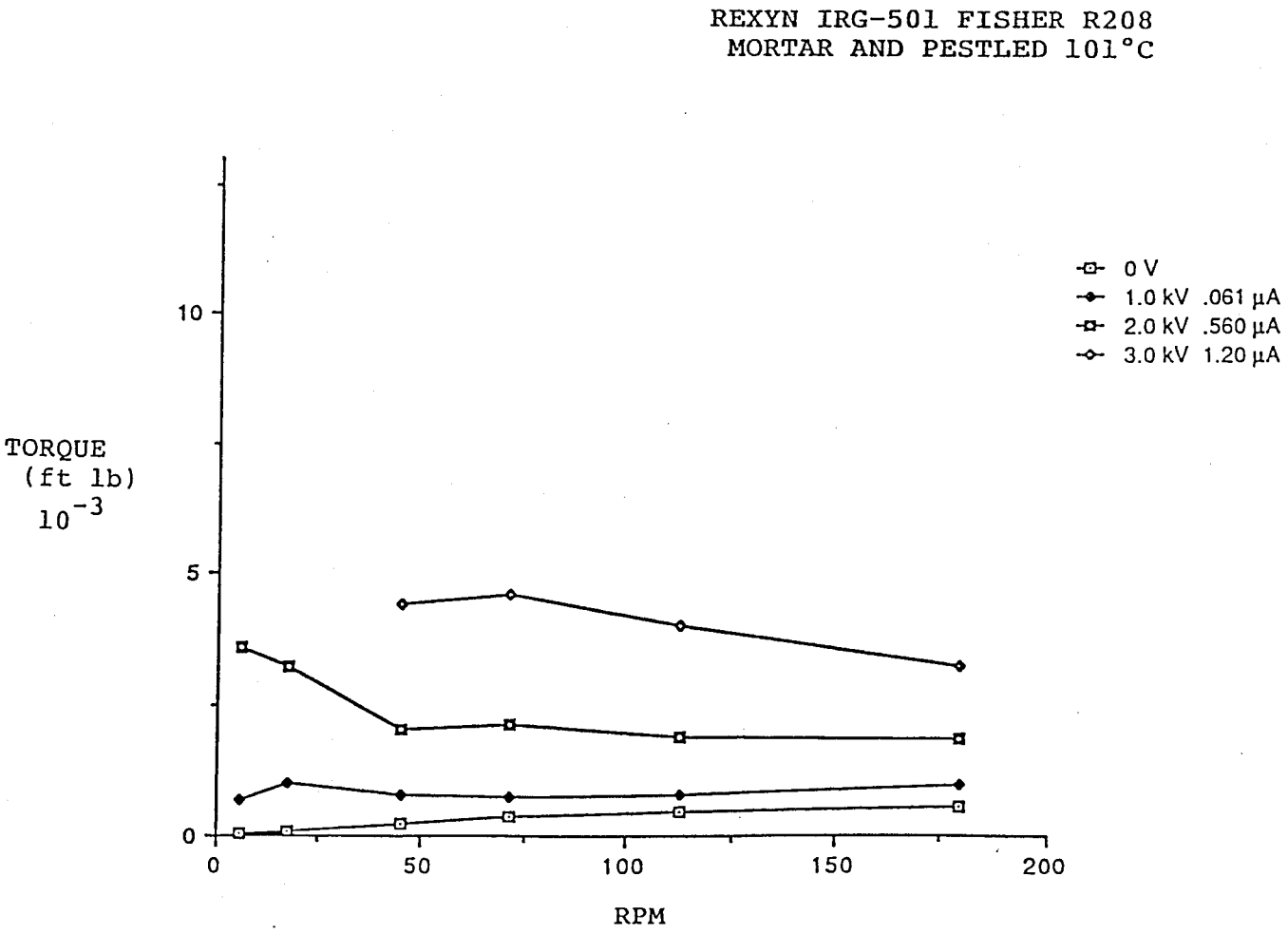
Figure 23:
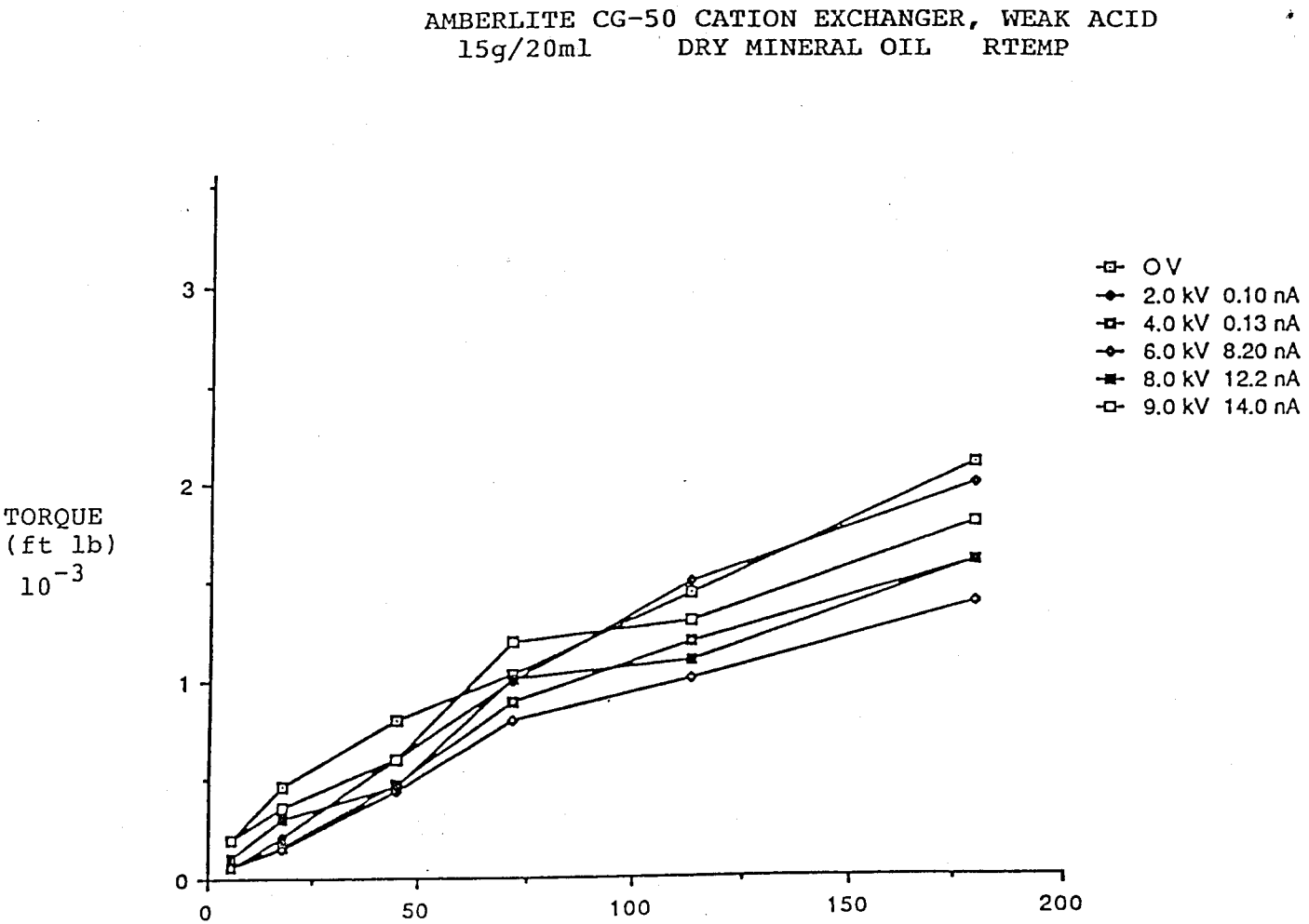
Figure 24:
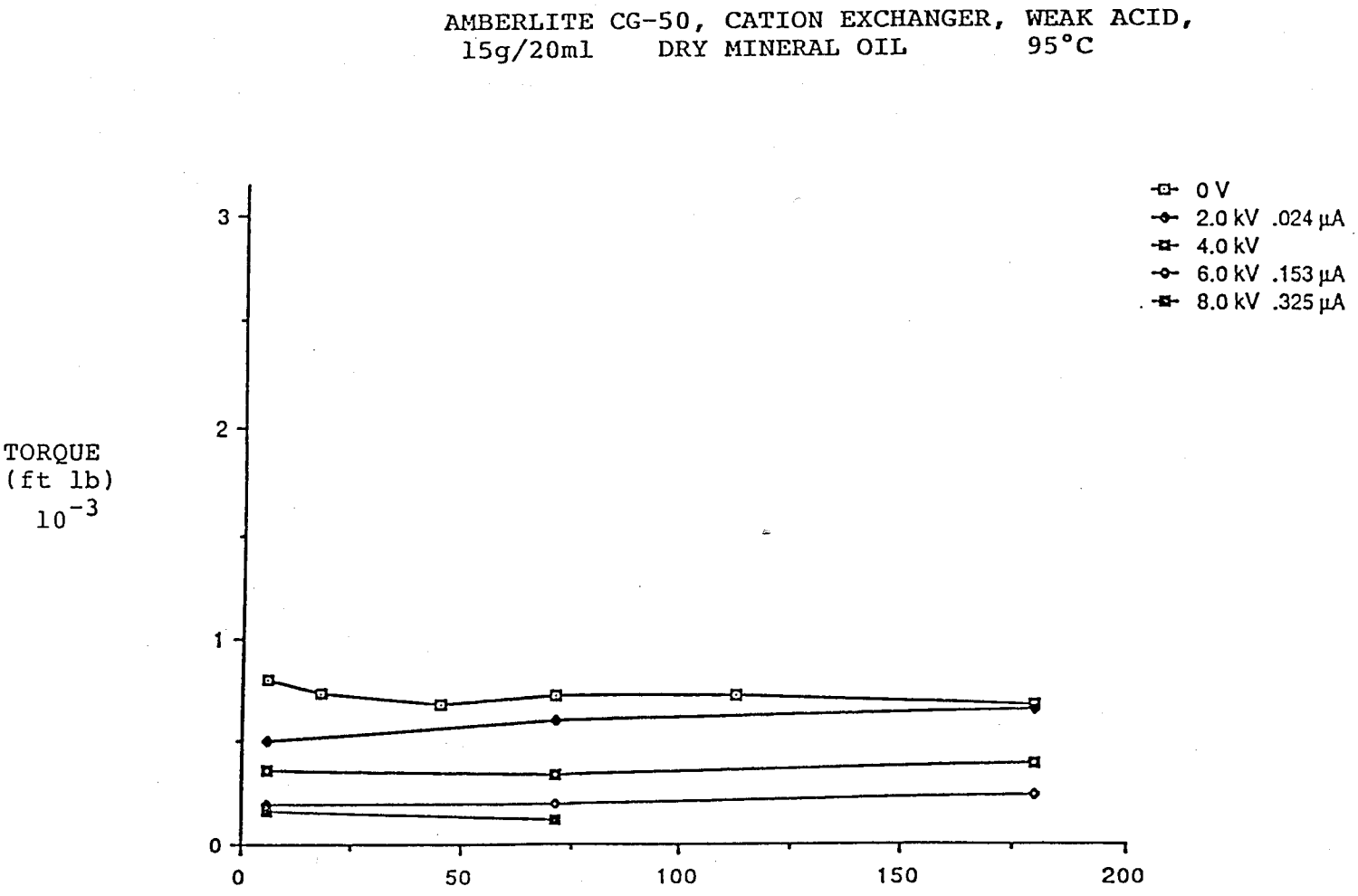
Figure 25:
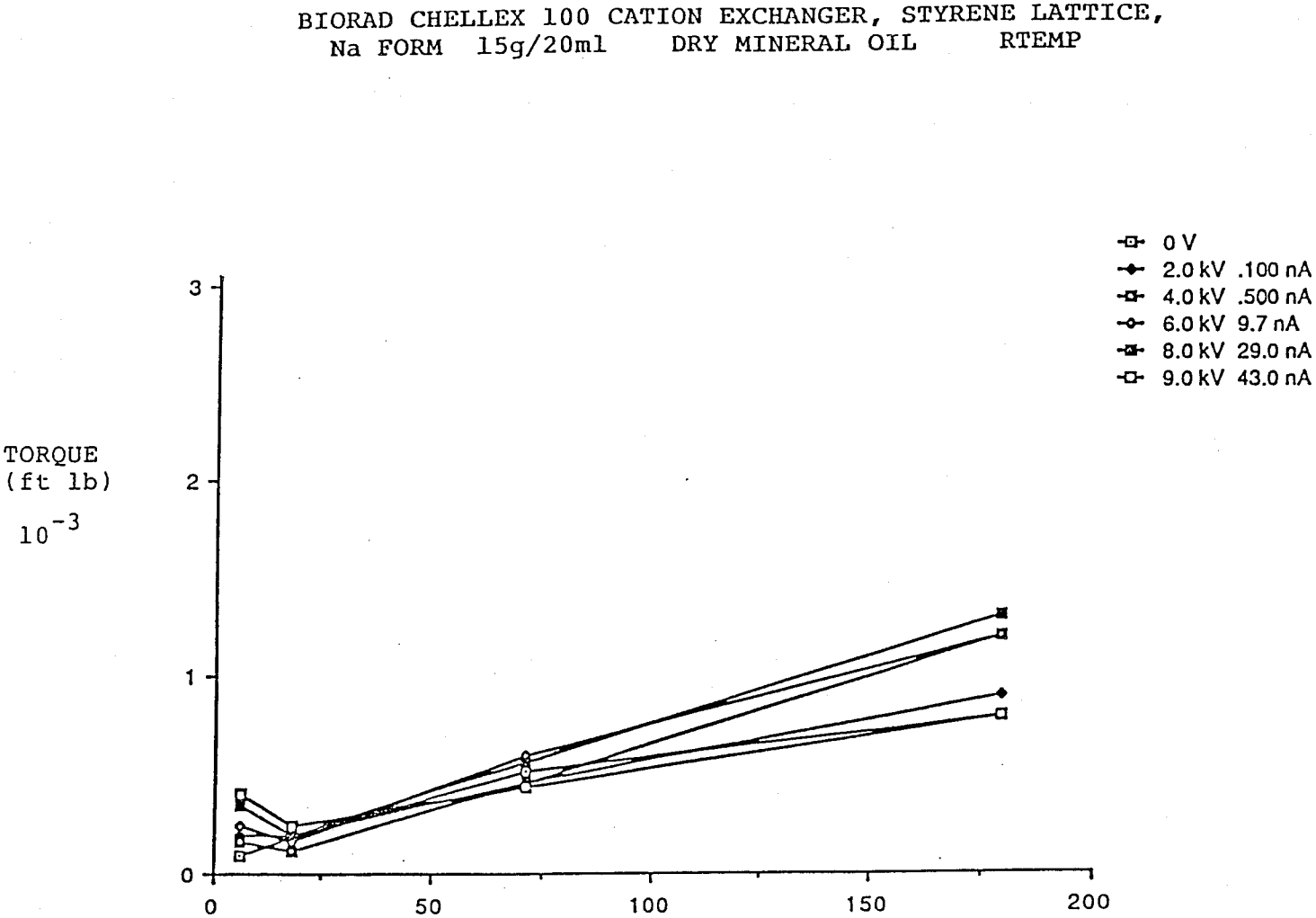
Figure 26:
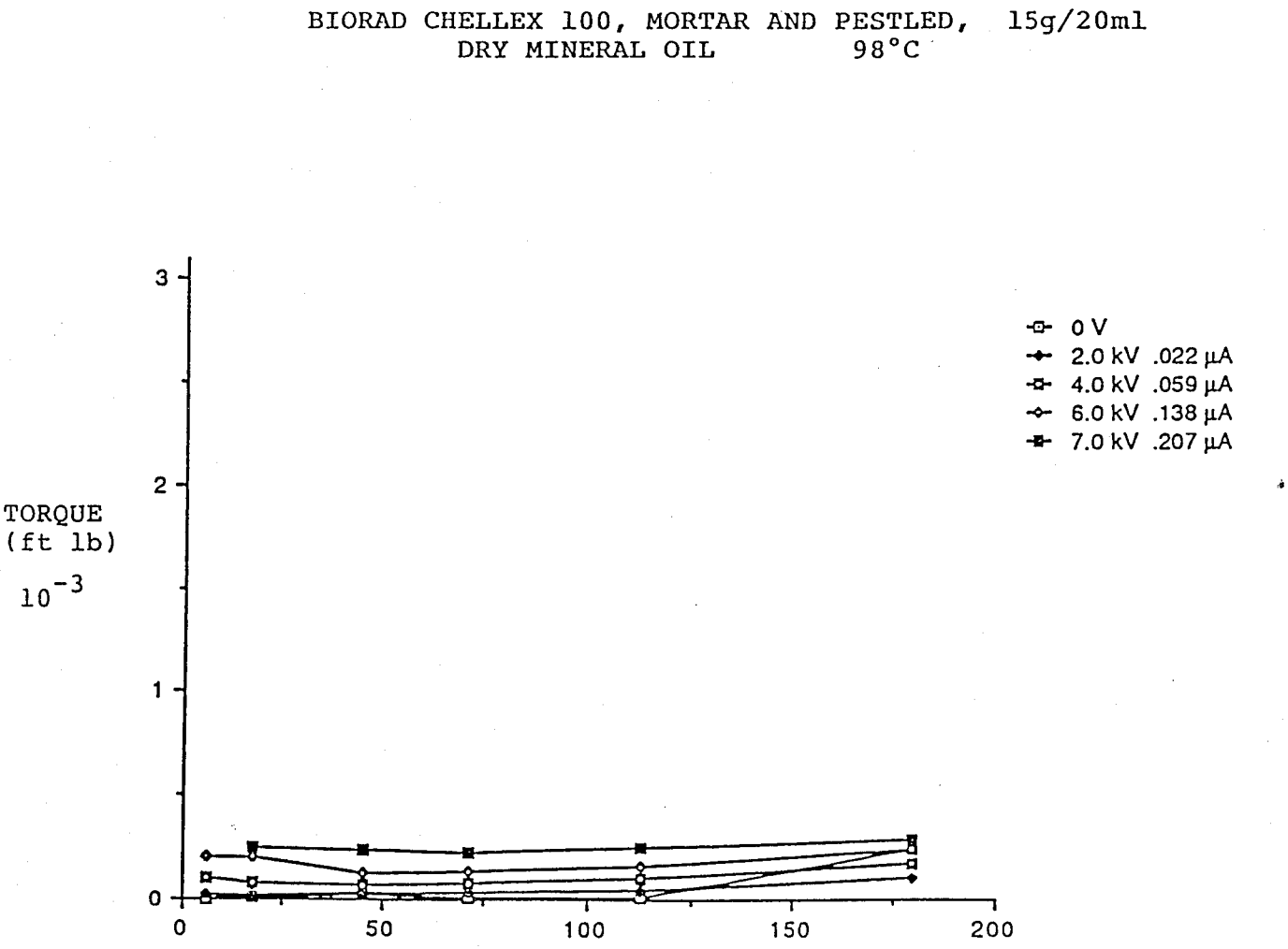
Figure 27:
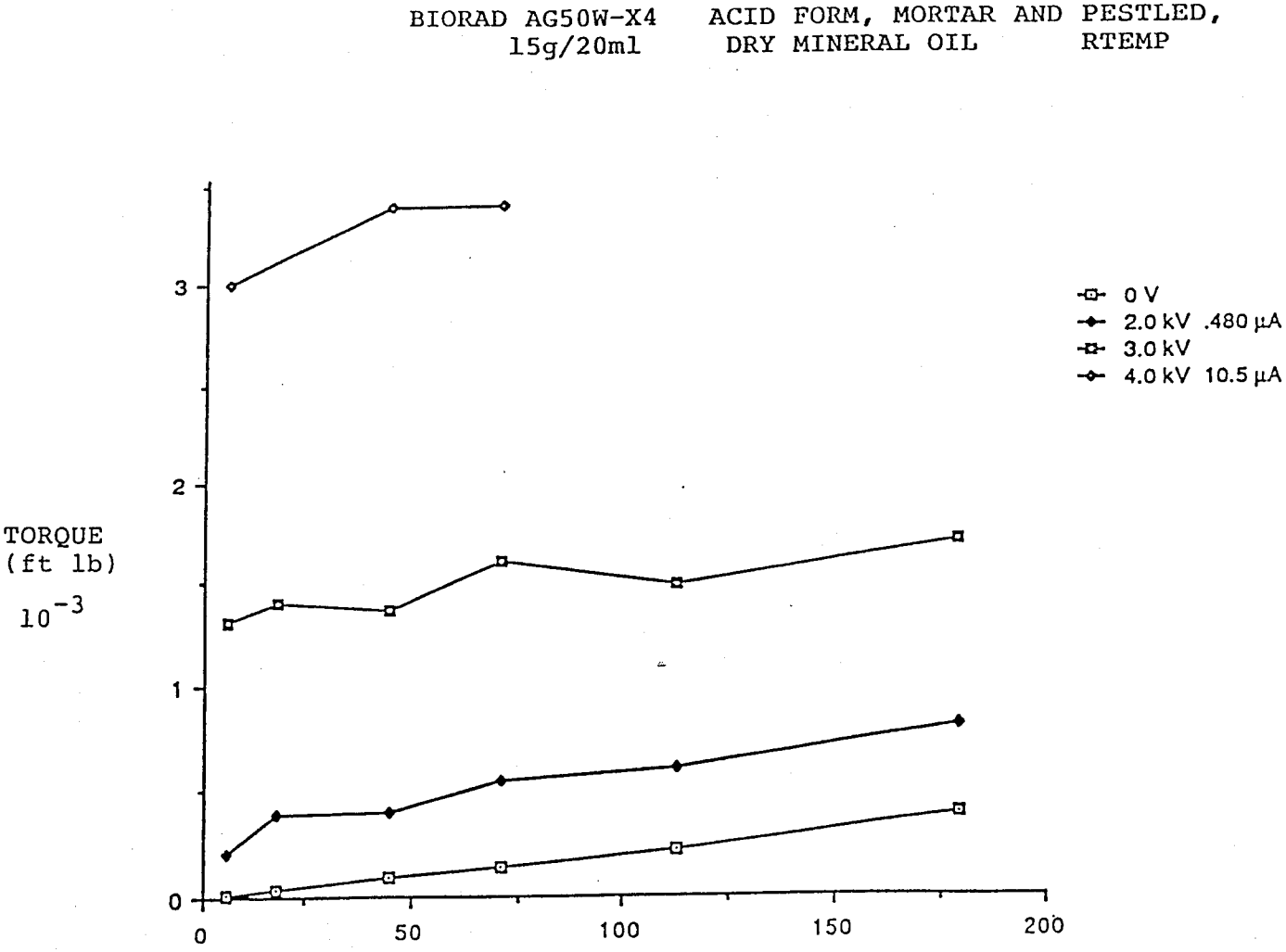
Figure 28:
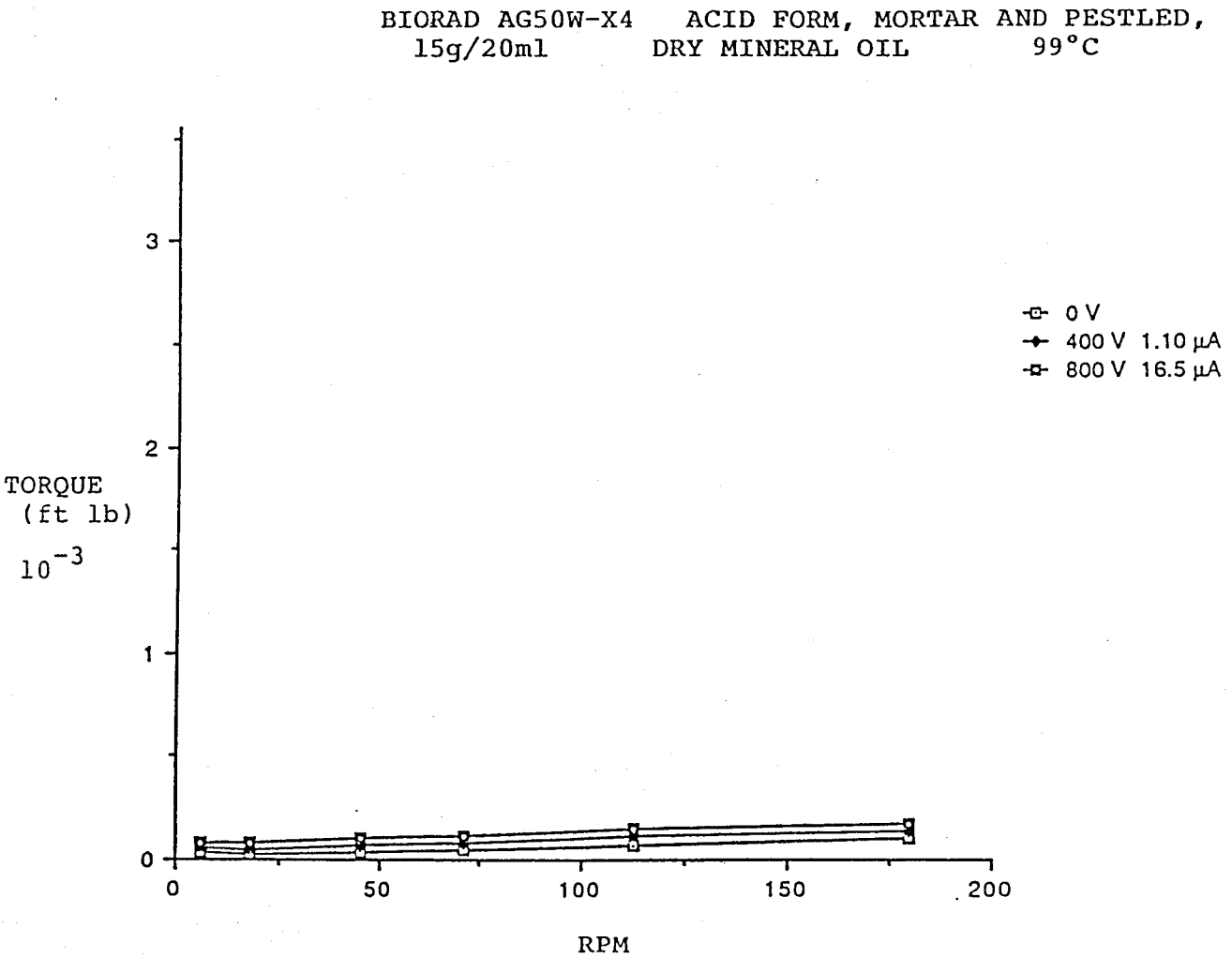
Figure 29:
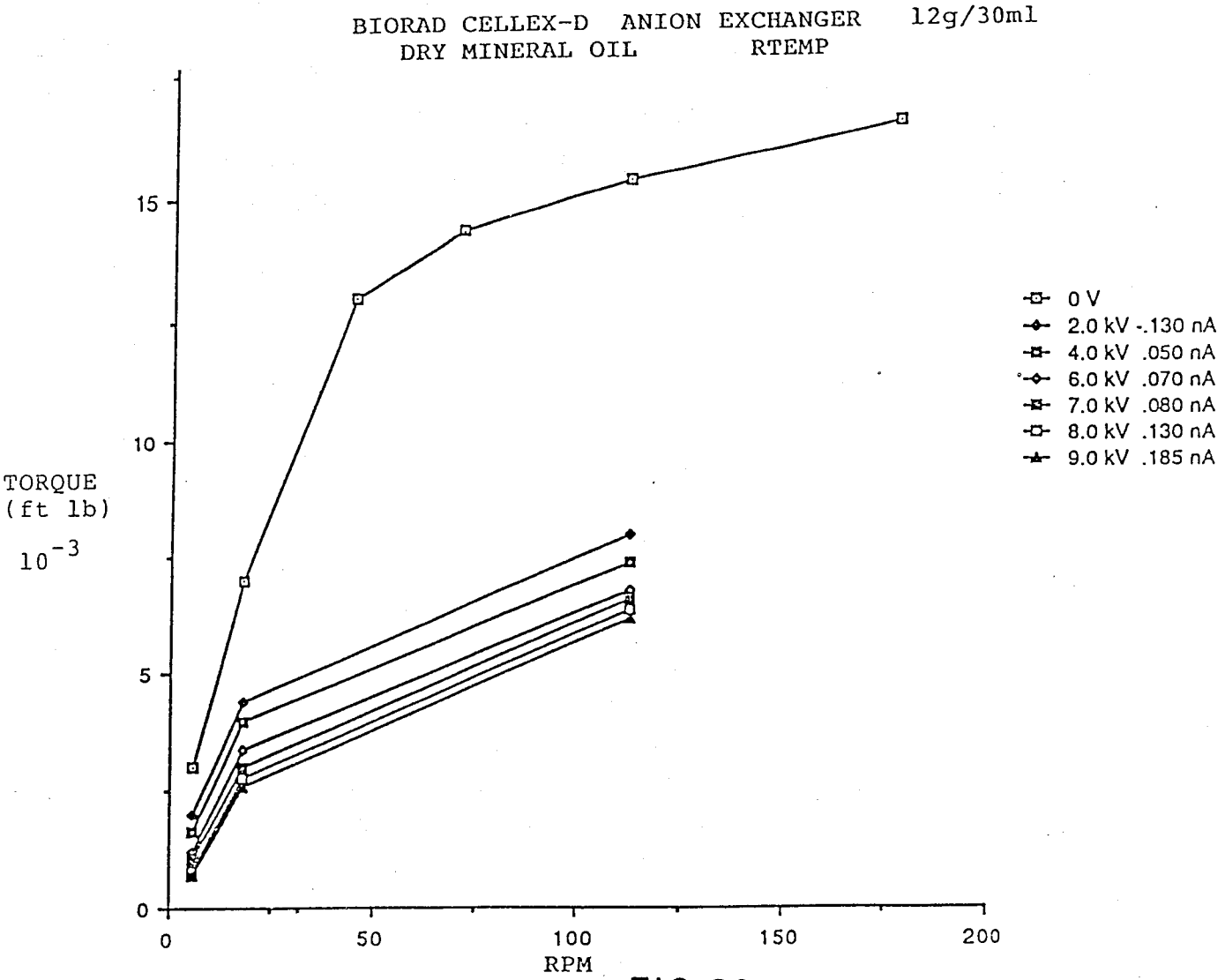
Figure 30:
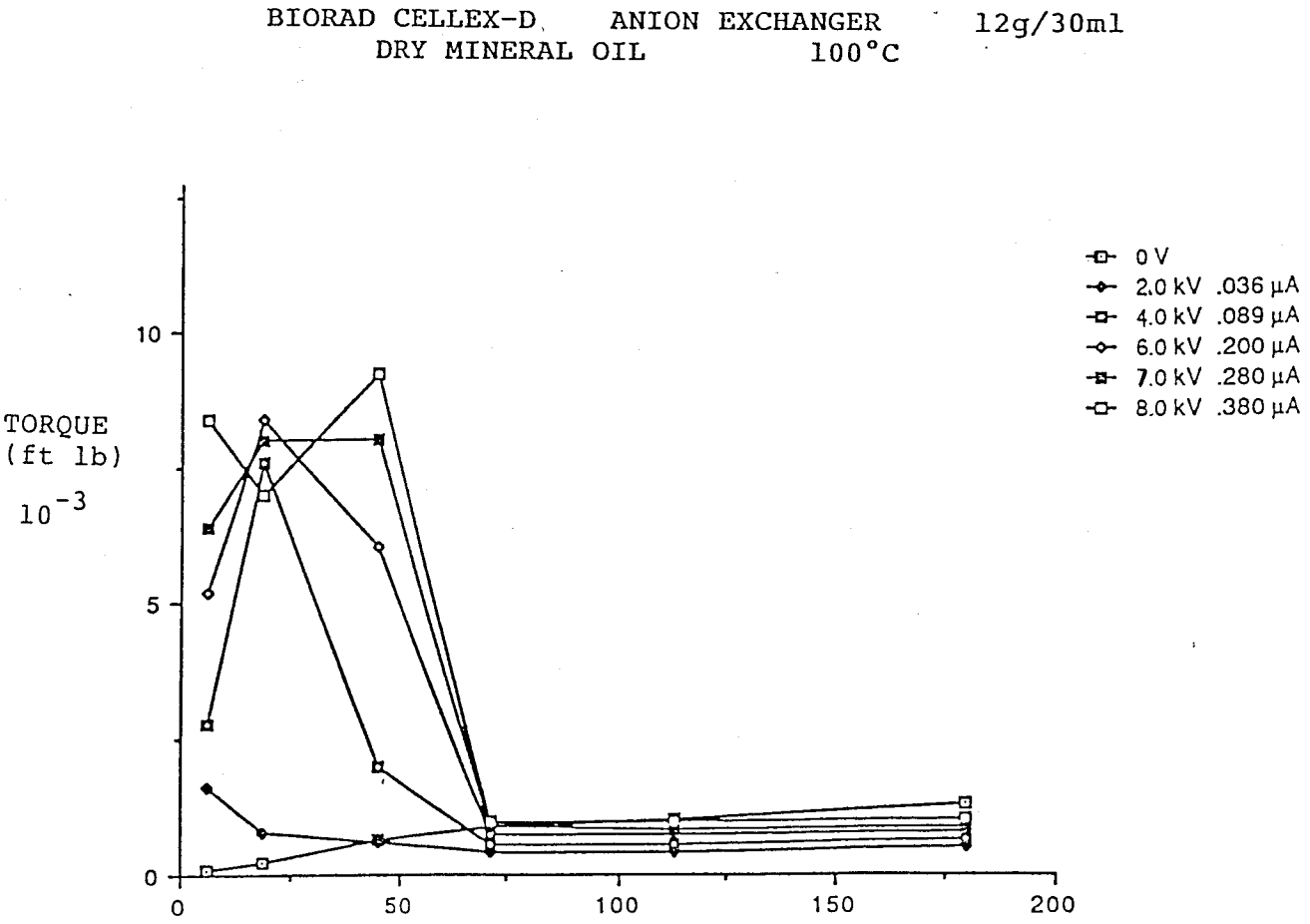
Figure 31:
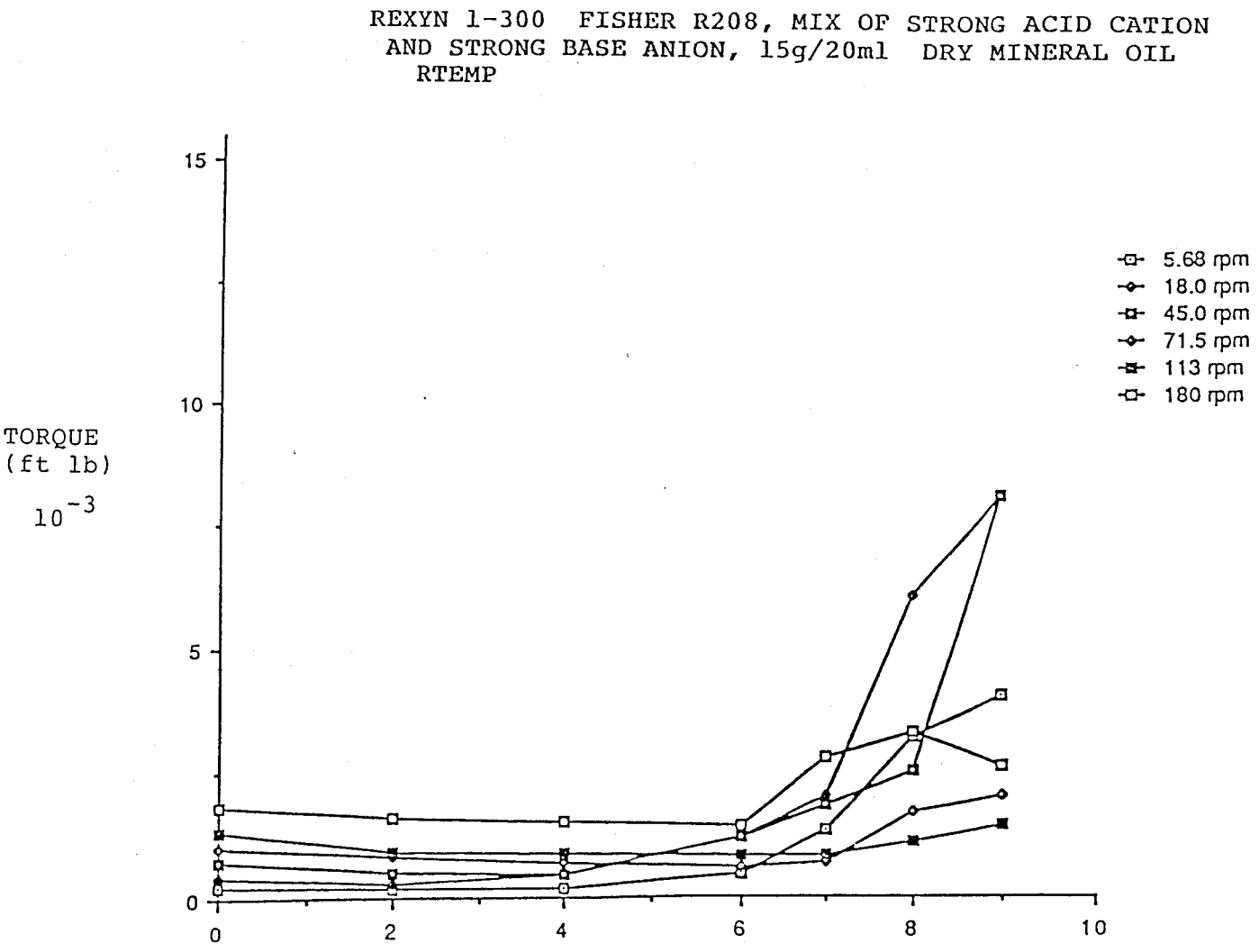
Figure 32:
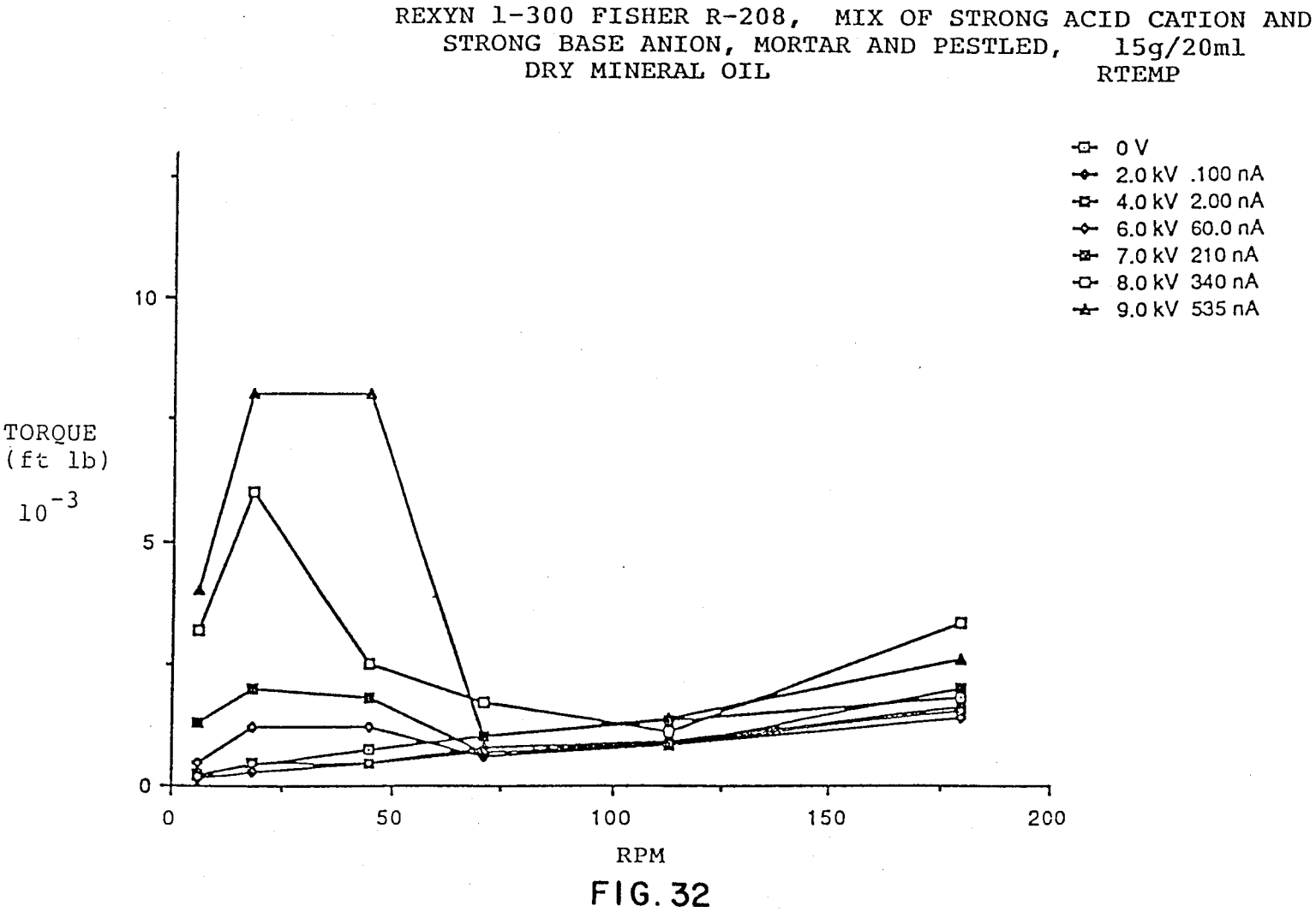
Figure 33:
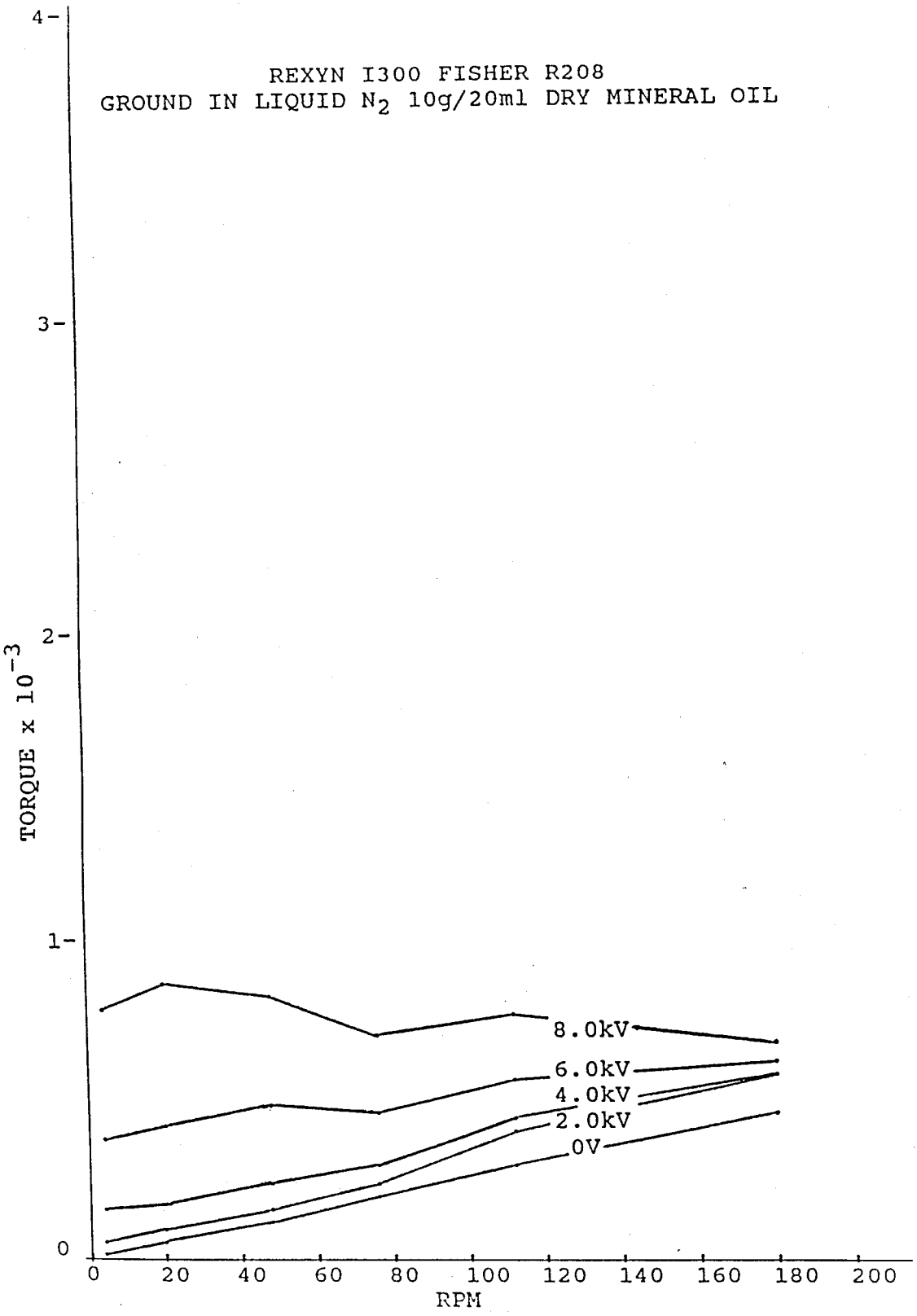
Figure 34:
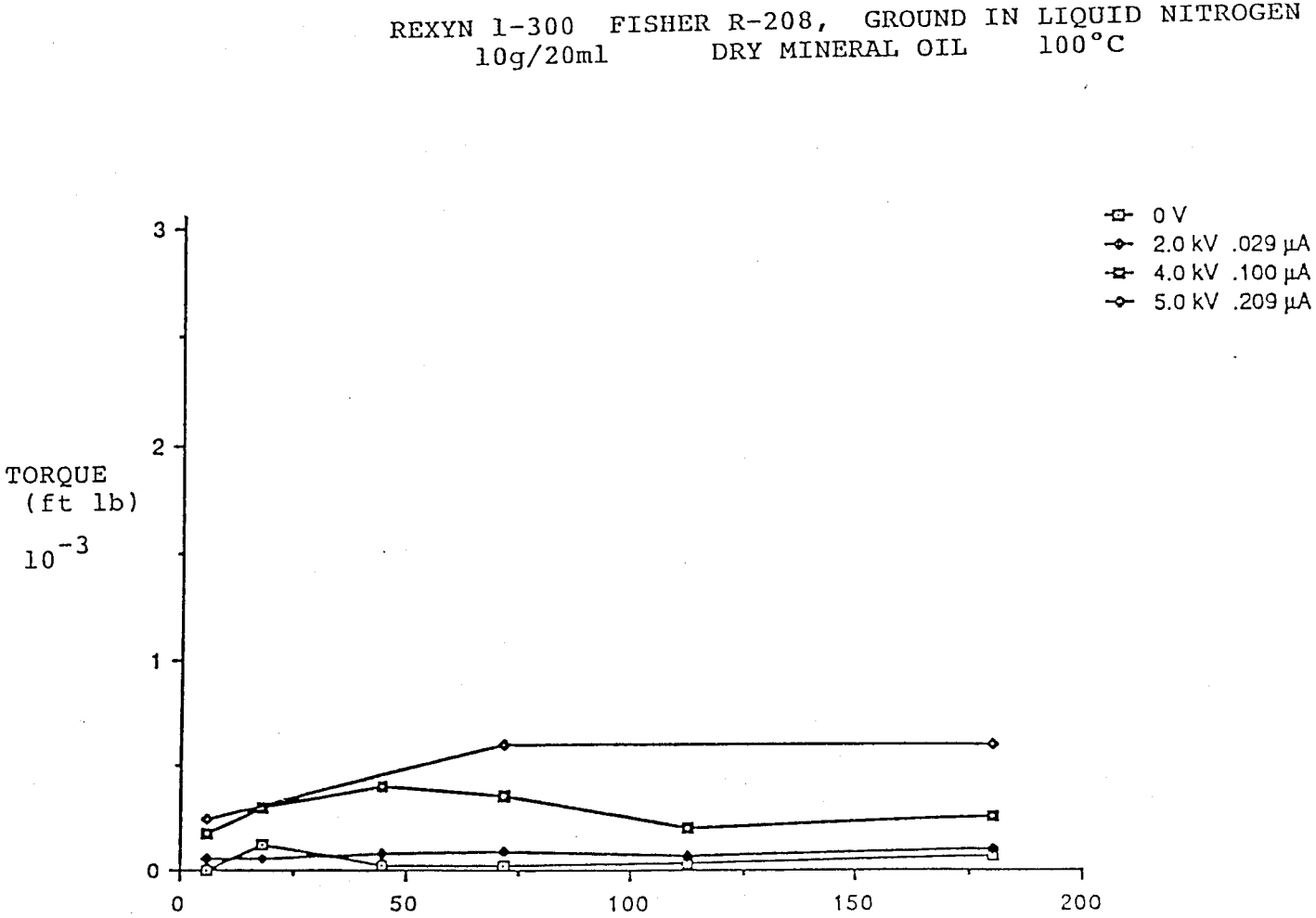
Figure 35:
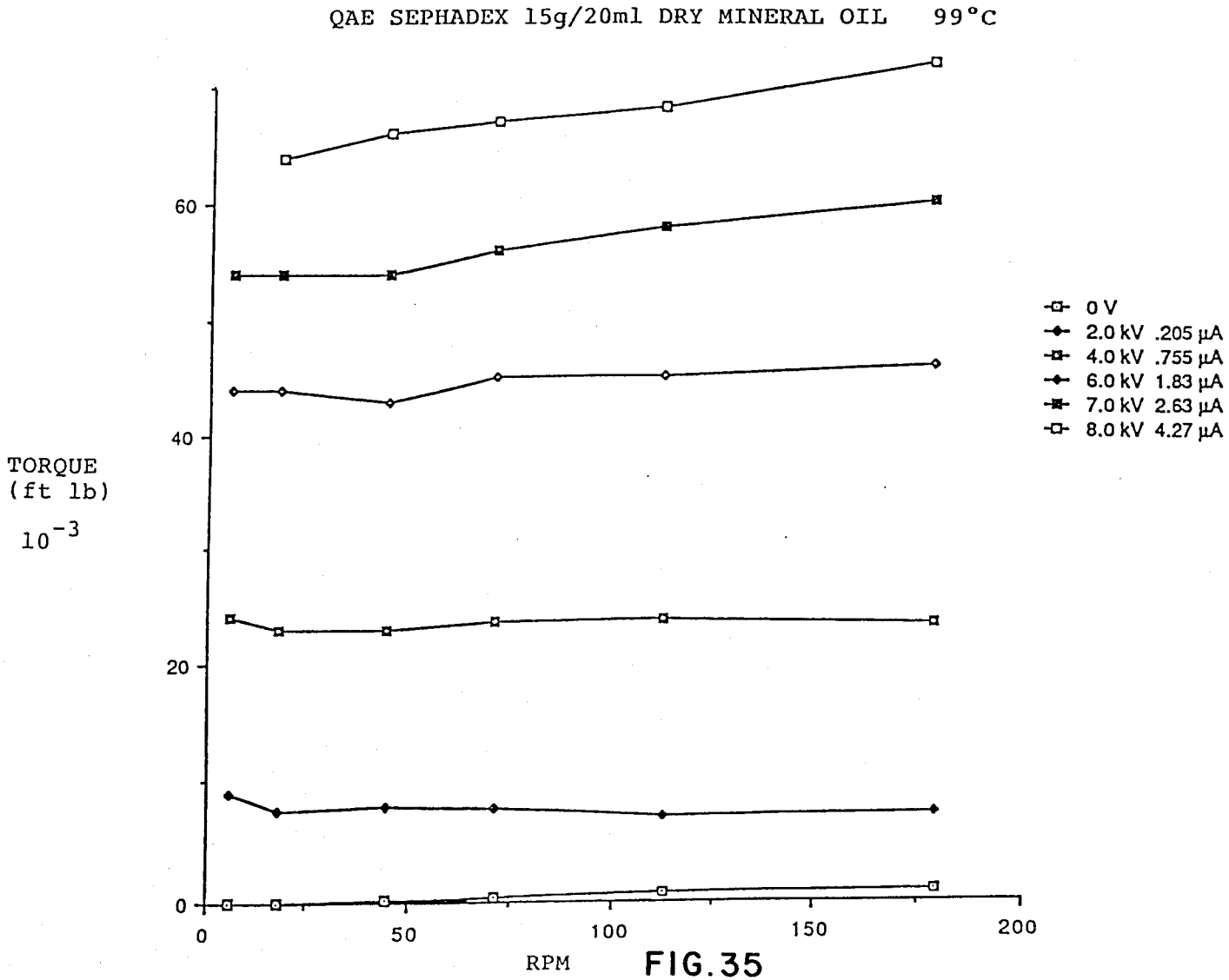
Figure 36:
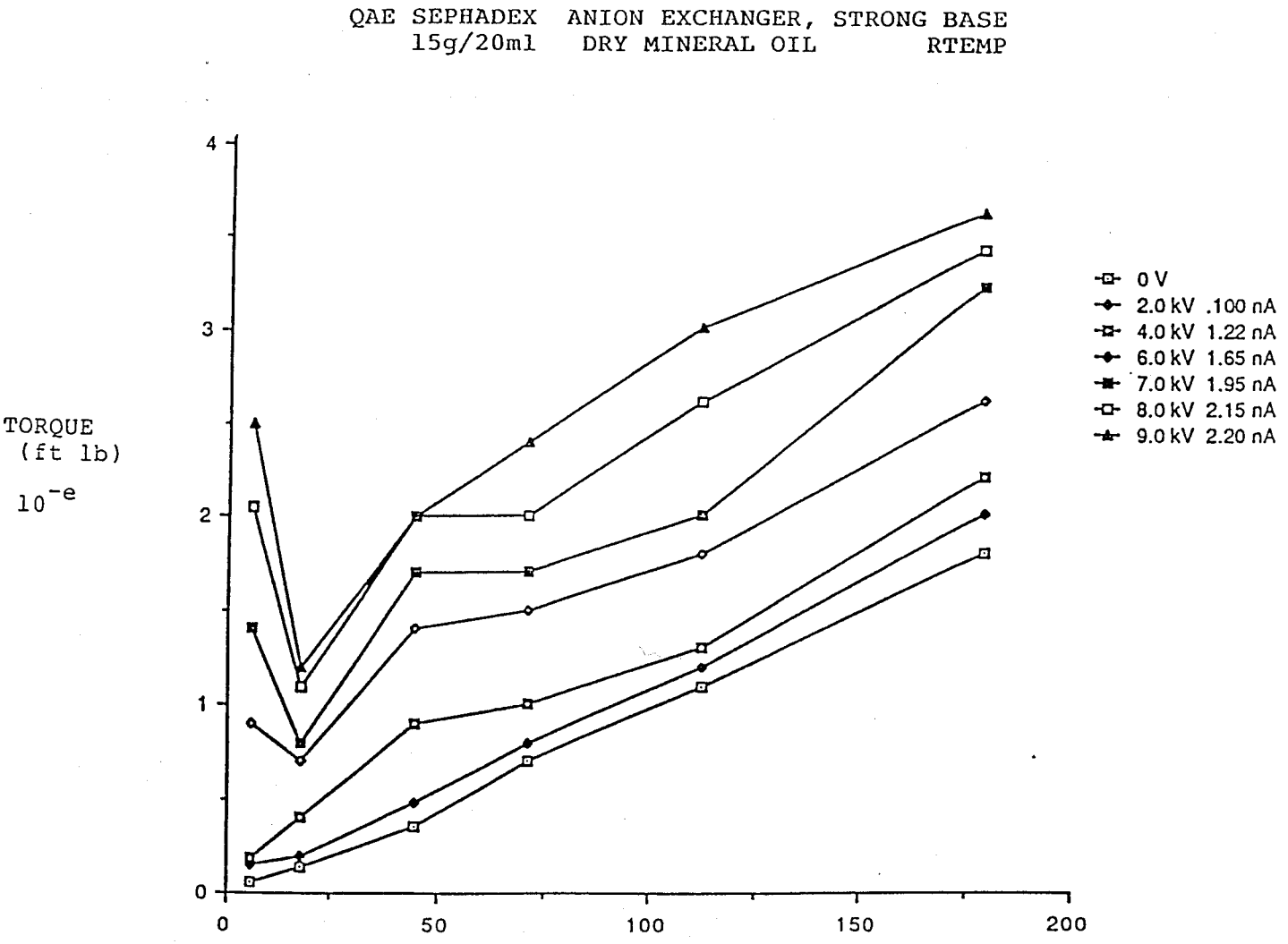
Figure 37:
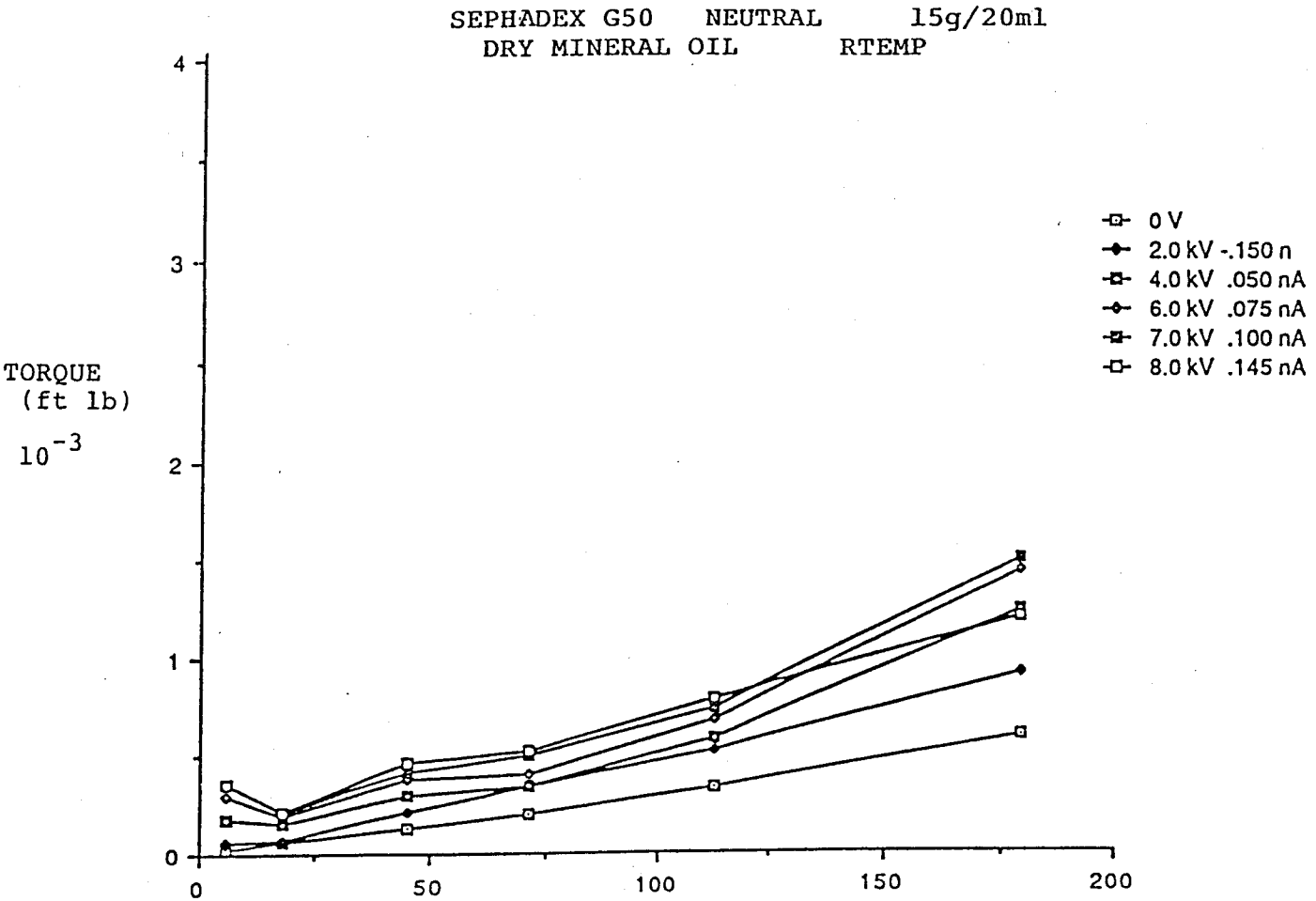
Figure 38:
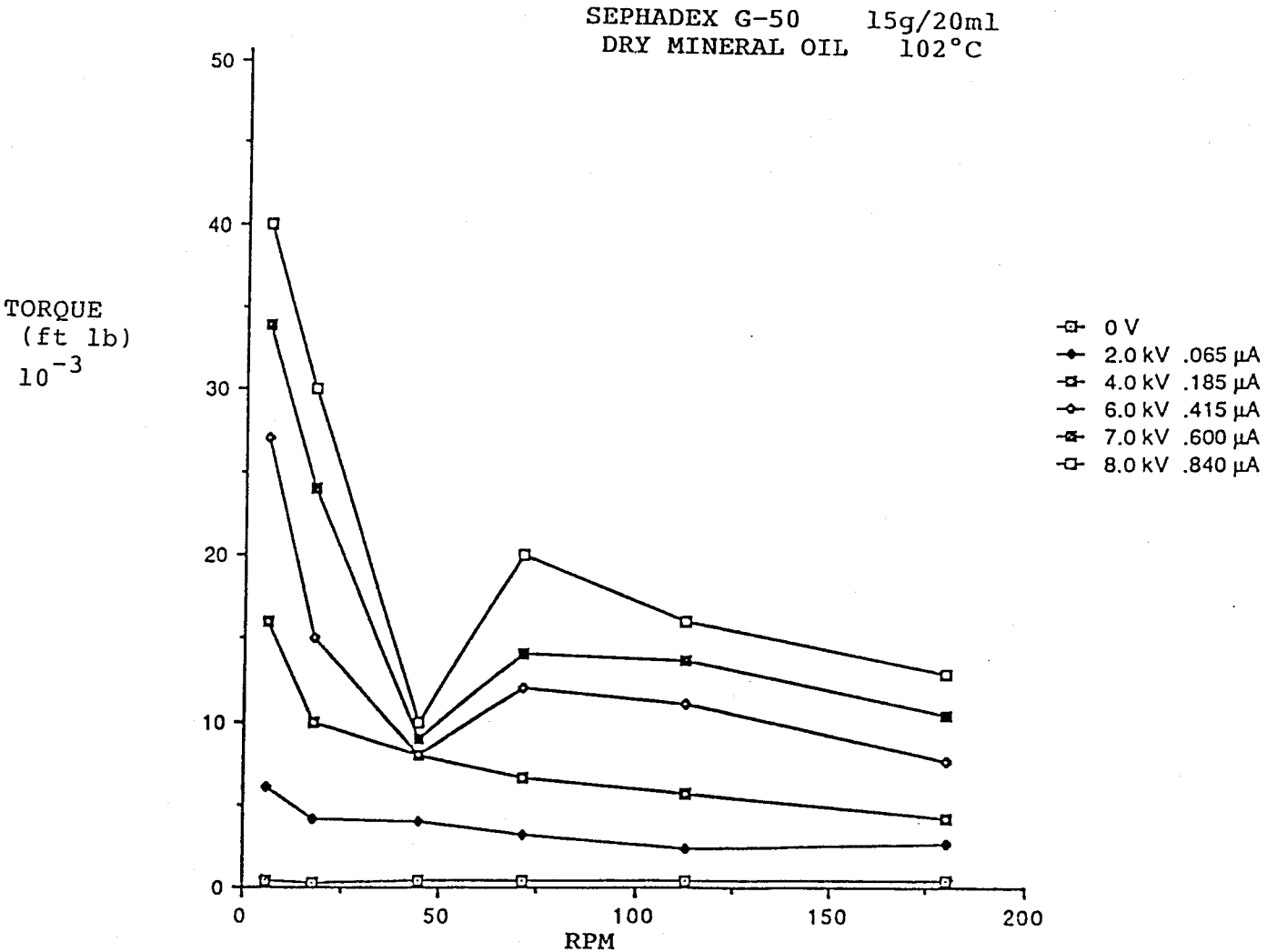
Figure 39:
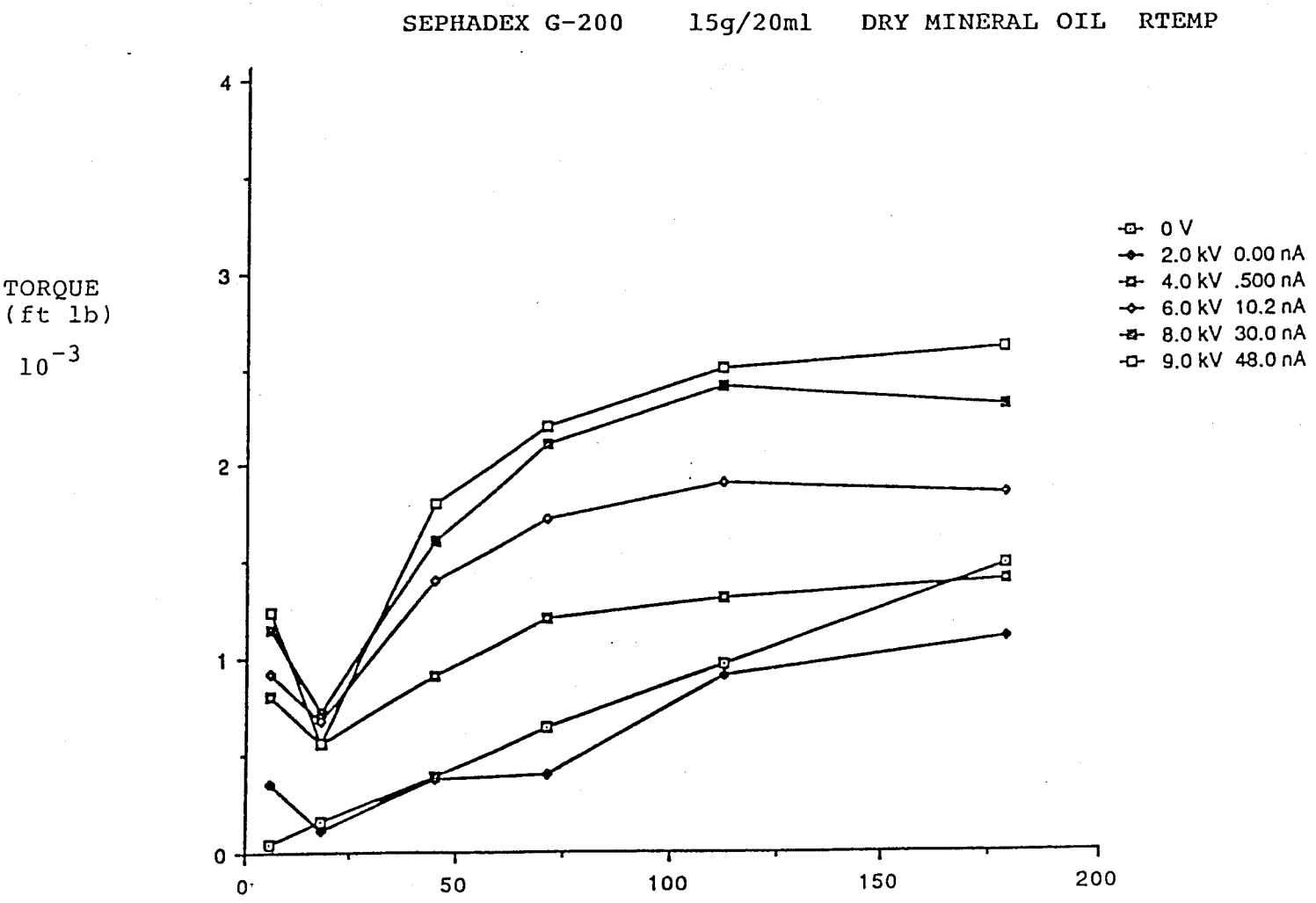
Figure 40:
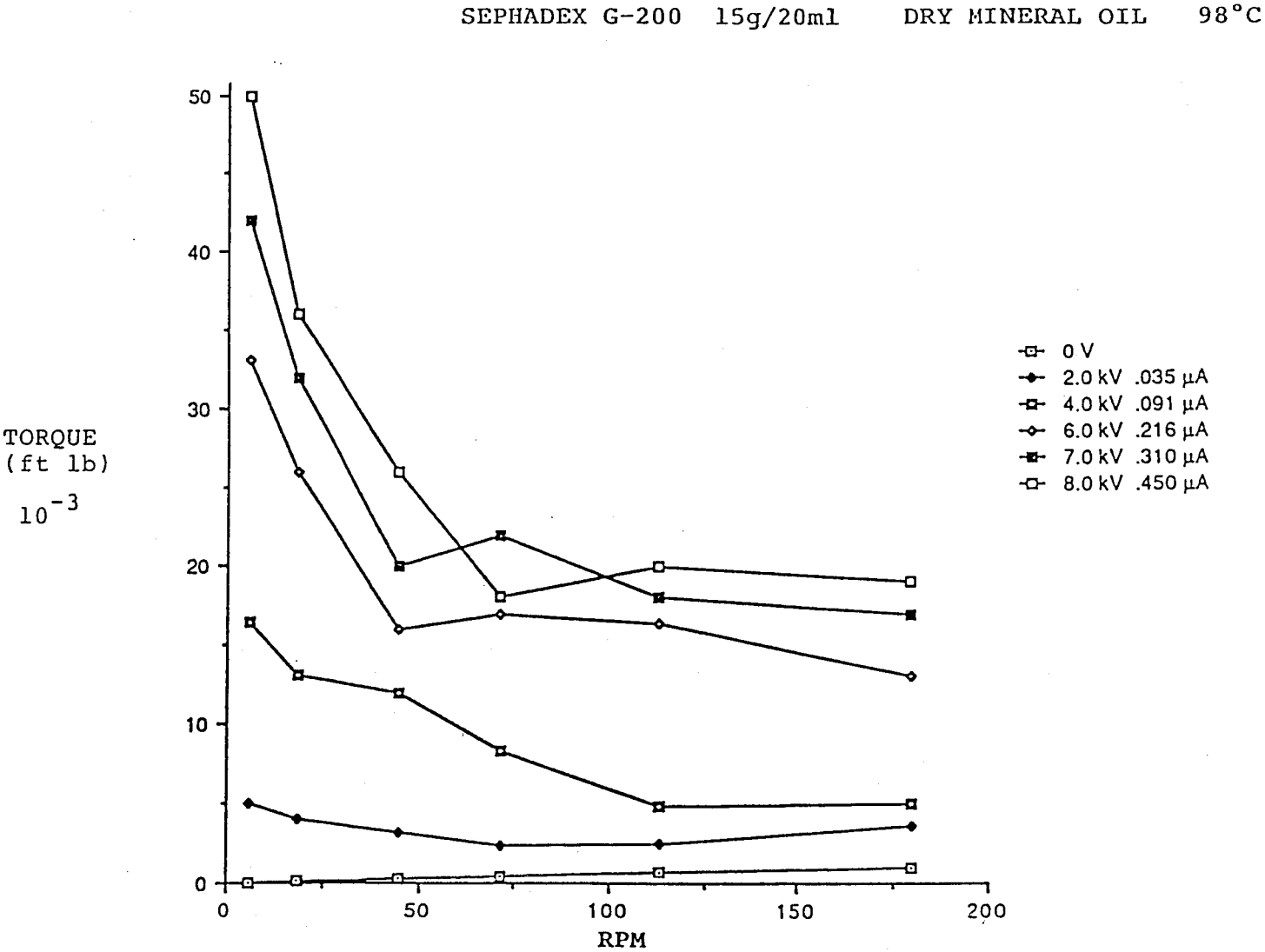
Figure 41:
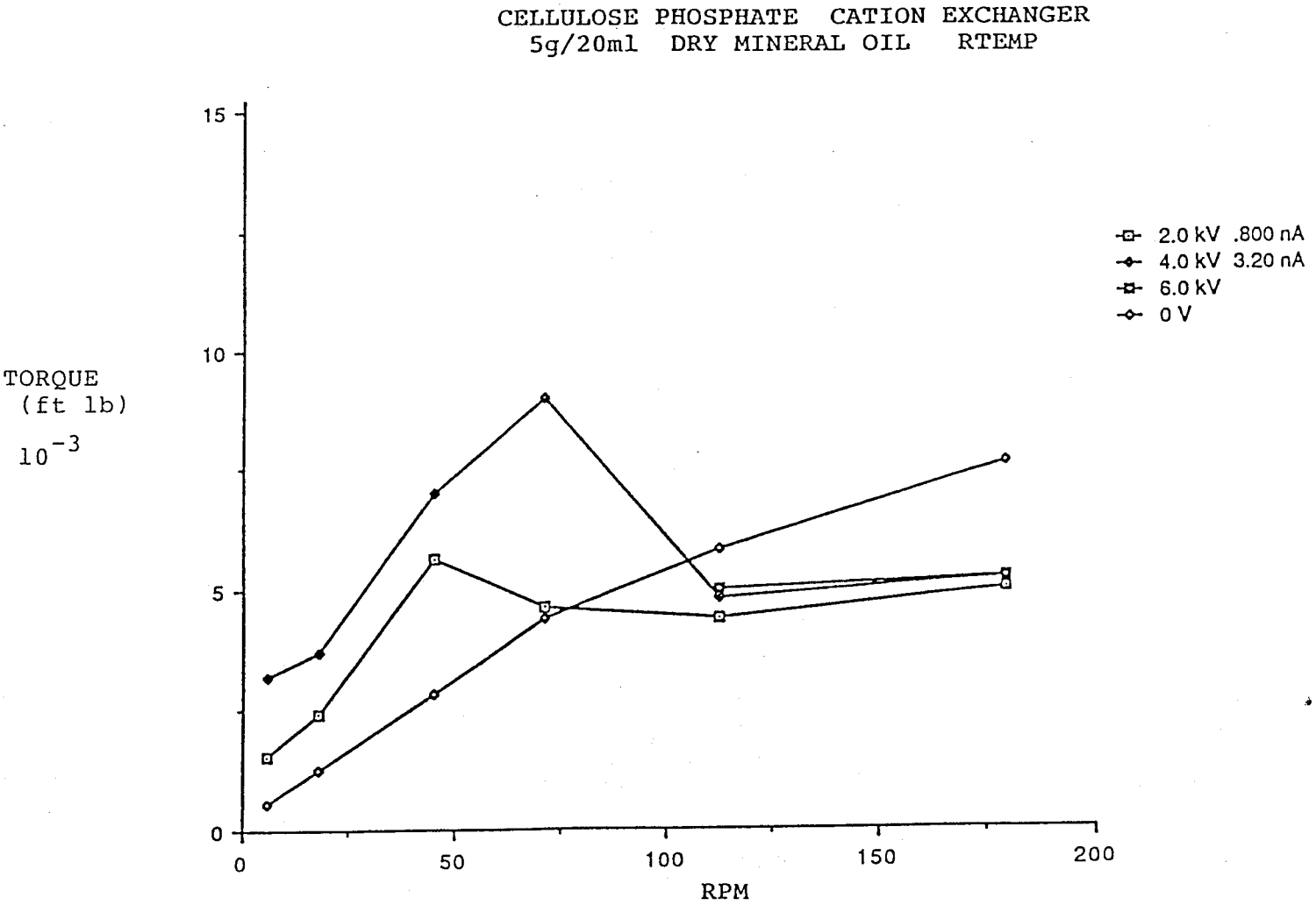
Figure 42:
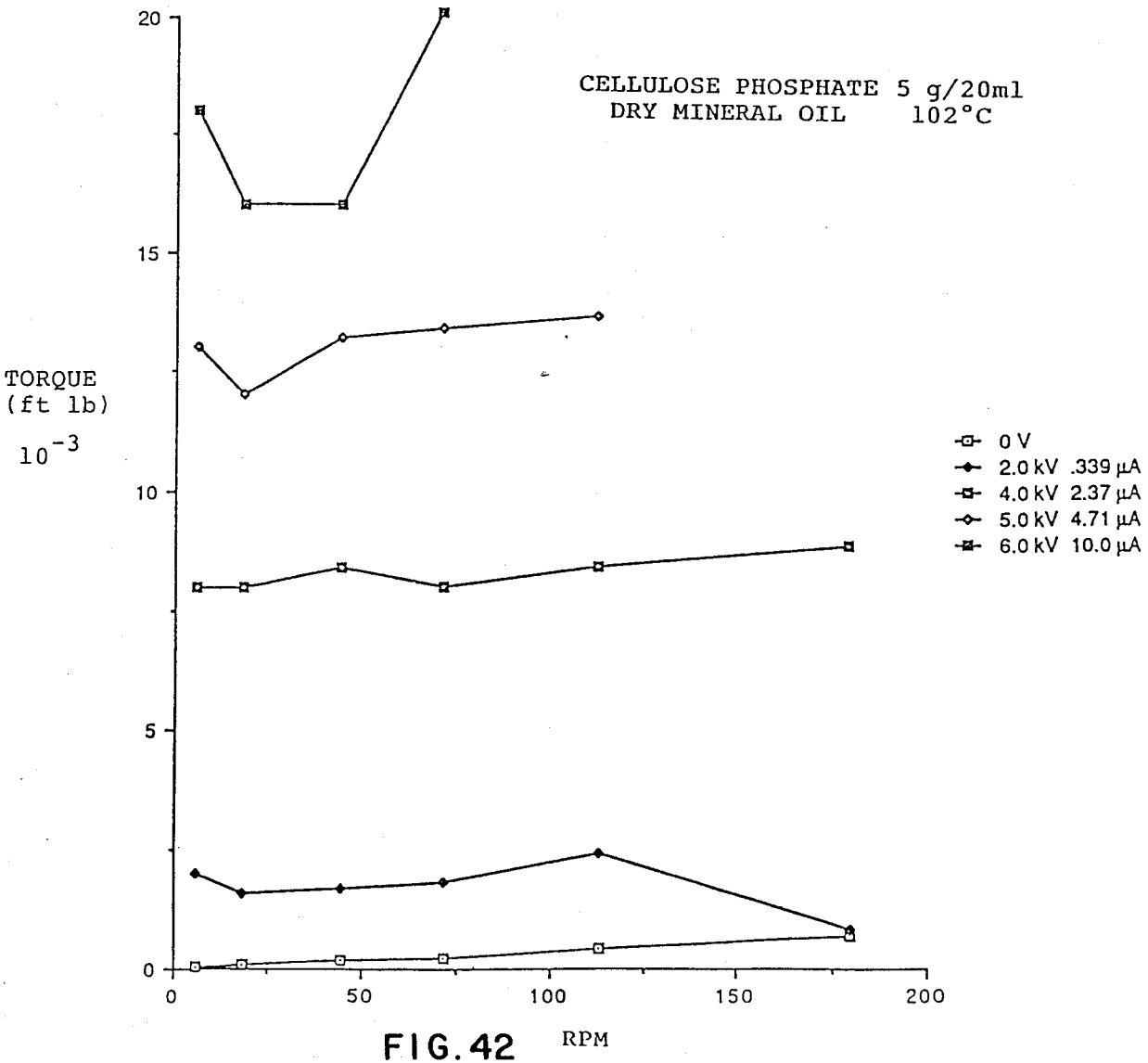
Figure 43:
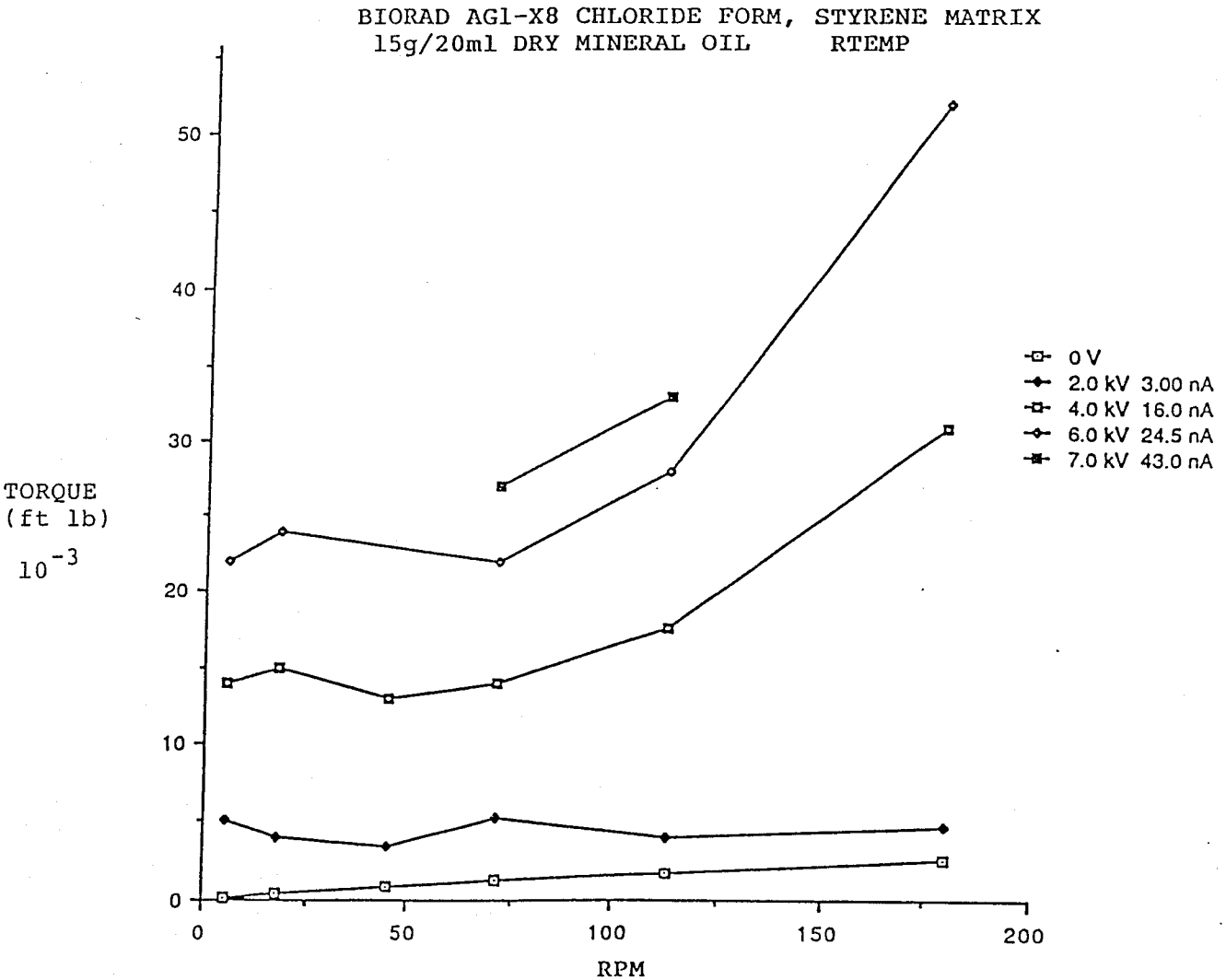
Figure 44:
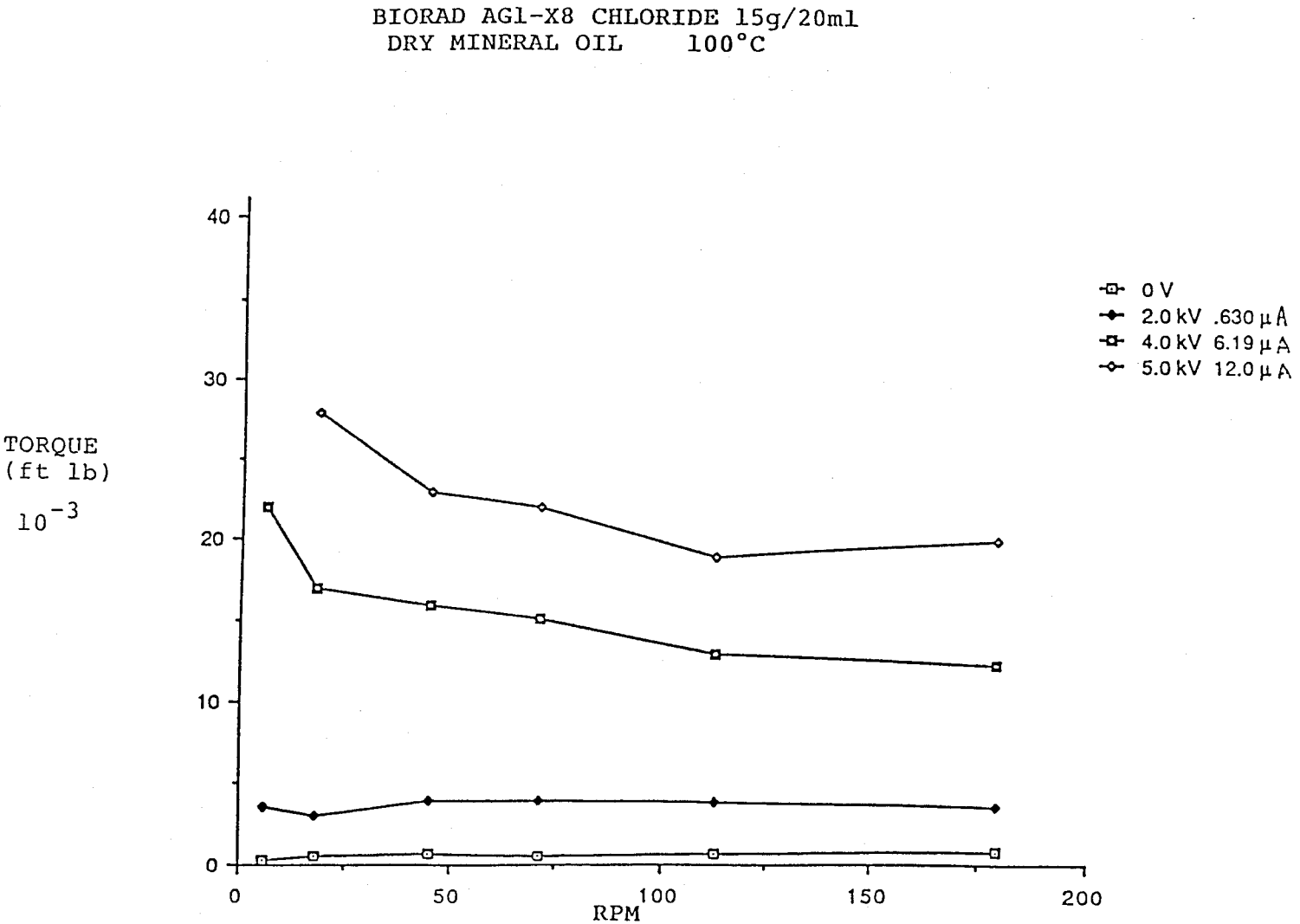
Figure 45:
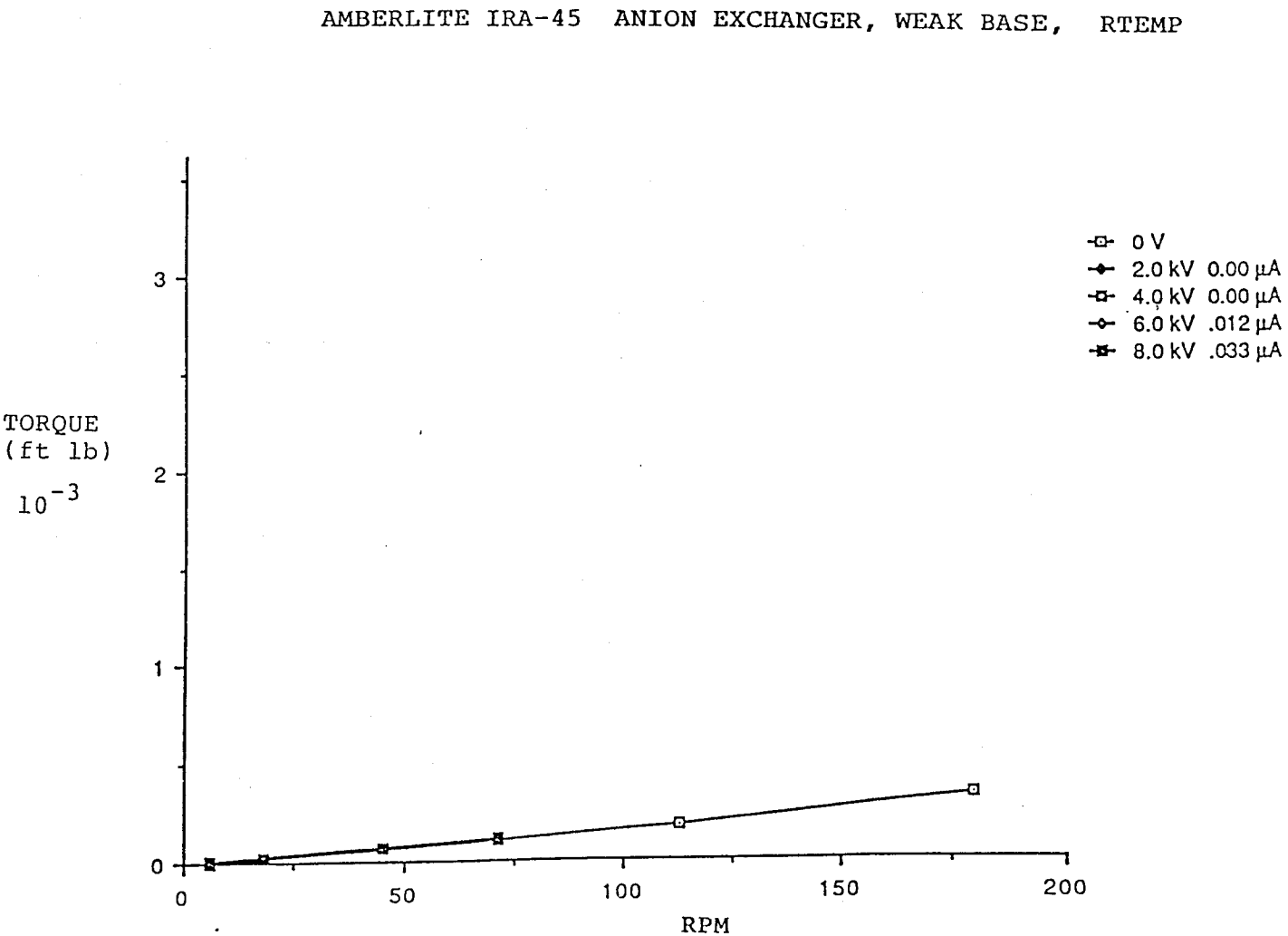
Figure 46:
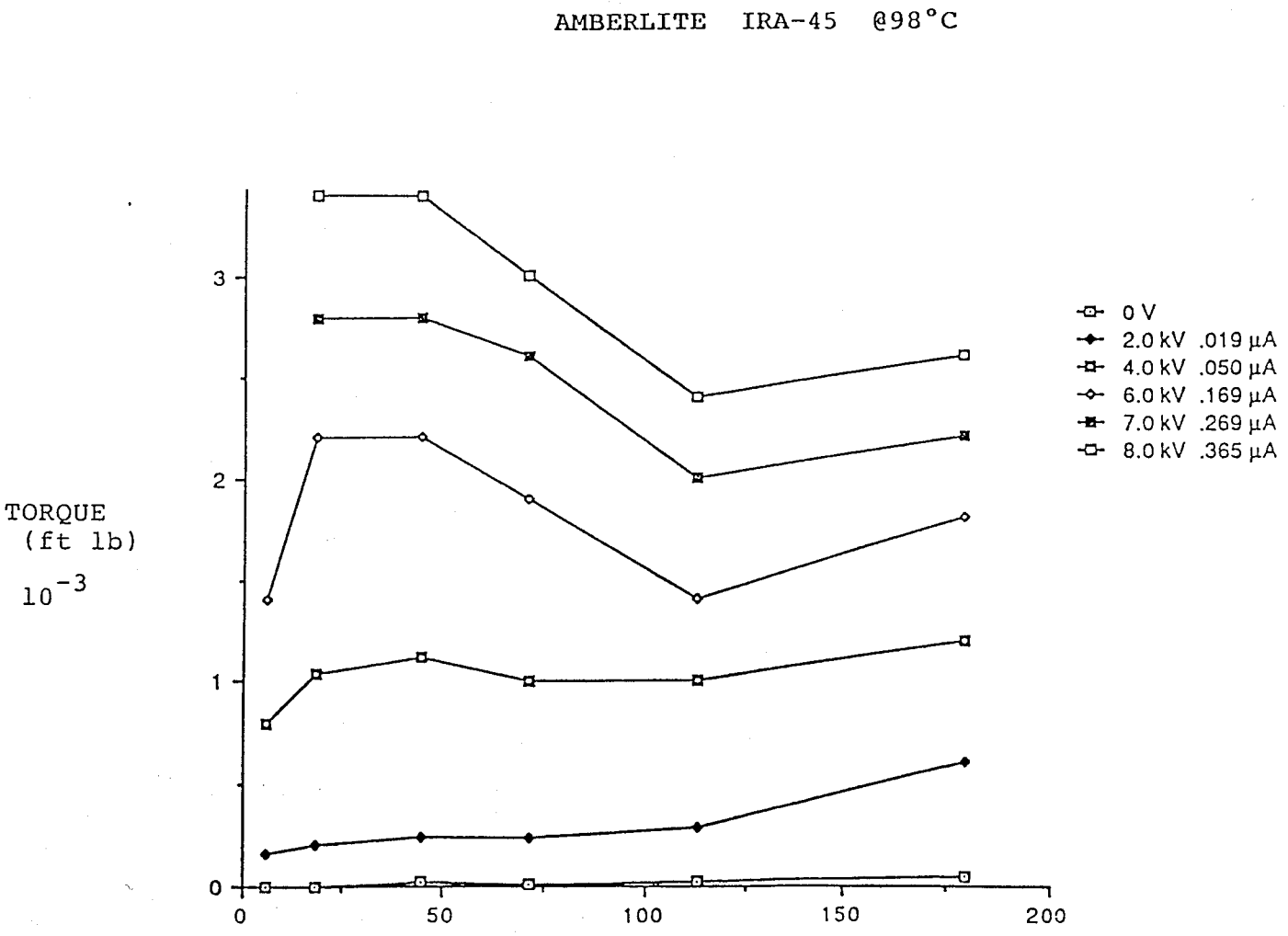

The following Examples IX through XLVI summarize the details of a series of individual fluids being measured and the conditions under which the measurements were performed. In each case the transmission of torque was recorded as a function of rpm at a specified imposed voltage. The current flow across the electrodes of the Weisenberg Rheogoniometer was measured and for purposes of claiming the present invention, the electrical measurements were converted to current density using the nominal dimensions of cylindrical bob and annular spacing between the cup and bob. The corresponding FIGS. 9 through 46 present the resulting data graphically for the respective examples as plots of measured or observed torque transmitted as a function of the rpm at various applied voltages along with the observed current. The table summarizes the performance of the electroheological fluids using selective data points at high and low rpm and three different concentrations (low, medium and high). For each fluid tested, the rate of increase of the dynamic transmission of torque per unit voltage, dM/dV, is presented in the left column at high rpm and at low rpm. The right column for each fluid tested has, on the top of the box, a ratio or fraction wherein the numerator, M, is the value of the dynamic transmission of torque observed at a high electric field strength corresponding to at least 2.4 kV d.c. across the 0.050 annular spacing, and the denominator represents the value of the dynamic transmission of torque, Mo, observed at a zero electric field strength (no imposed d.c. voltage). The lower left corner of each box represents the numerical value of this ratio, M/Mo. The lower right-hand corner contains the maximum d.c. voltage, in kV, imposed on the fluid before dielectric breakdown (i.e., before electrical arcing took place). The high concentration corresponds to approximately 900 grams of particulate phase per liter of liquid and the low concentration corresponds to approximately 500 grams of particulate phase per liter of liquid and the medium concentration is about halfway in between. The high temperature measurements were made at about 120 ° C. and the low temperature measurements at about 40 ° C. with the medium temperature halfway between. The high rpm corresponds to about 180 rpm and the low from about 5 to 19 rpm. The dM/dV for high concentration zeolite fluid ranged from about 1 to 8 with the low concentration zeolite fluid ranging up to about 3. The ion exchange resins and organic polymer polyelectrolyte resins showed a somewhat broader range of dM/dV. The increase of dynamic transmission of torque at high electric field relative to zero field was almost consistently in excess of about 2.

TABLE

| | | Zeolite 3A Dry/EVTn | | Zeolite 4A Dry/EVTn | | Zeolite 5A Dry/EVTn | | Zeolite 10A Dry EVTn | | Zeolite 3A AR/EVTn | |
|---|---|---|---|---|---|---|---|---|---|---|---|
| | | dM/dV | M/Mo | dM/dV | M/Mo | dM/dV | M/Mo | dM/dV | M/Mo | dM/dV | M/Mo |
| HIGH CONCENTRATION | | | 9.6/.15 | | 6.8/.6 | | | | | | |
| | high rpm | 3.2 | 64 4 | .83 | 11 2.4 | | | | | | |
| high temperature | | | 8.7/.04 | | 4.7/.1 | | | | | | |
| | low rpm | 3.3 | 217 4 | 3.6 | 47 2.4 | | | | | | |
| | | | 10/.33 | | 16/1.2 | | | | | | |
| | high rpm | 2.0 | 30 3.6 | 8.1 | 13 2.4 | | | | | | |
| medium temperature | | | 7/.054 | | 10/.2 | | | | | | |
| | low rpm | 1.3 | 130 3.6 | 5.2 | 50 2.4 | | | | | | |
| | | | 6.4/.1 | | 31/9 | | | | | | 16/3.2 |
| | high rpm | 1.9 | 64 3.6 | 8.4 | 3.5 3.2 | | | | | 4 | 5 4 |
| low temperature | | | 4/.05 | | 18/.75 | | | | | | 9.4/.34 |
| | low rpm | 1.6 | 80 3.6 | 5.3 | 25 3.2 | | | | | 2.6 | 28 4 |
| MED. CONCENTRATION | | | | | | | | | | | |
| | high rpm | | | | | | | | | | |
| high temperature | | | | | | | | | | | |
| | low rpm | | | | | | | | | | |
| | high rpm | | | | | | | | | | |
| medium temperature | | | | | | | | | | | |
| | low rpm | | | | | | | | | | |
| | | | | | | | | | | | 10/1.5 |
| | high rpm | | | | | | | | | 2.6 | 6.7 4 |
| low temperature | | | | | | | | | | | 8.6/.07 |
| | low rpm | | | | | | | | | 2.7 | 128 4 |
| LOW CONCENTRATION | | | 3/.08 | | | | 3.4/.08 | | 2.9/.31 | | |
| | high rpm | 1.4 | 38 3.2 | | | .7 | 42 5.6 | 1.5 | 9.4 2.8 | | |
| high temperature | | | 27/.04 | | | | 6/.03 | | 1.9/.03 | | |
| | low rpm | 1.5 | 68 3.2 | | | 1.4 | 200 5.6 | 1.2 | 63 2.8 | | |
| | | | 4.1/.12 | | | | 2.2/.17 | | 2.4/.81 | | |
| | high rpm | 1.2 | 34 4.8 | | | 1.1 | 13 3.2 | 1.0 | 3 2.4 | | |
| medium temperature | | | 4/.016 | | | | 1.6/.03 | | .62/.06 | | |
| | low rpm | 1.2 | 250 4.8 | | | .92 | 57 3.2 | .47 | 10 2.4 | | |
| | | | 8.8/.32 | | | | 2.4/.54 | | 6.5/3.5 | | 7.9/.5 |
| | high rpm | 2.0 | 28 5.6 | | | .47 | 4.4 4.8 | 1.4 | 1.9 3.2 | 1.7 | 16 5 |
| low temperature | | | 5.2/.04 | | | | .26/.03 | | 1.9/.12 | | 6.4/.08 |
| | low rpm | 0.6 | 130 5.6 | | | .034 | 8.7 4.8 | .81 | 16 3.2 | 1.5 | 80 5 |
| | | Zeolite 5A | | Zeolite 10A | | QAE | | Sephadex | | Sephadex | |

TABLE-continued

| | | AR/EVTn | | AR/EVTn | | Sephadex | | G-50 | | G-200 | |
|---|---|---|---|---|---|---|---|---|---|---|---|
| | | dM/dV | M/Mo | dM/dV | M/Mo | dM/dV | M/Mo | dM/dV | M/Mo | dM/dV | M/Mo |
| HIGH CONCENTRATION | | | | | 19/6.9 | | | | | | |
| | high rpm | | | 3.7 | 2.8 3.2 | | | | | | |
| high temperature | | | | | 14/.59 | | | | | | |
| | low rpm | | | 4 | 24 3.2 | | | | | | |
| | high rpm | | | | | | | | | | |
| medium temperature | | | | | | | | | | | |
| | low rpm | | | | | | | | | | |
| | | | 11/9.3 | | 39/20 | | | | | | |
| | high rpm | 1.1 | 1.2 8 | 5.7 | 1.95 4 | | | | | | |
| low temperature | | | 6/1.2 | | 26/1.6 | | | | | | |
| | low rpm | | 5 8 | 6.3 | 16 4 | | | | | | |
| MED. CONCENTRATION | | | | | 4.8/.27 | | 61/.13 | | 12/.3 | | 19/.79 |
| | high rpm | | | 1.9 | 18 3 | 10.5 | 470 8 | 1.7 | 40 8 | 2.5 | 24 8 |
| high temperature | | | | | 3.6/.07 | | 71/.076 | | | | |
| | low rpm | | | 1.4 | 54 3 | 9 | 930 8 | 5.7 | | | |
| | high rpm | | | | | | | | | | |
| medium temperature | | | | | | | | | | | |
| | low rpm | | | | | | | | | | |
| | | | 6.6/2.7 | | 21/3.6 | | 3.6/1.8 | | 1.4/.57 | | 2.6/1.5 |
| | high rpm | .6 | 2.4 8 | 4.1 | 5.8 3 | .23 | 2 8 | .11 | 2.4 7 | .21 | 1.7 9 |
| low temperature | | | 2.8/.47 | | 13/.18 | | 2.5/.05 | | .35/.02 | | 1.2/.03 |
| | low rpm | .42 | 6 8 | 2.9 | 72 3 | .33 | 50 8 | .06 | 17.5 7 | .12 | 37 9 |
| LOW CONCENTRATION | | | | | 1.8/.53 | | | | | | |
| | high rpm | | | .55 | 3.4 3 | | | | | | |
| high temperature | | | | | 2.1/.35 | | | | | | |
| | low rpm | | | .9 | 6 3 | | | | | | |
| | high rpm | | | | | | | | | | |
| medium temperature | | | | | | | | | | | |
| | low rpm | | | | | | | | | | |
| | | | 3.6/.98 | | 11/1.4 | | | | | | |
| | high rpm | .43 | 3.7 8 | 2.9 | 7.9 4 | | | | | | |
| low temperature | | | 1.3/.16 | | 4.6/.09 | | | | | | |
| | low rpm | .18 | 8.1 8 | 1.3 | 51 4 | | | | | | |

| | | cellulose Phosphate | | Biorad AG1-X8 | | Amberlite IRA-45 | |
|---|---|---|---|---|---|---|---|
| | | dM/dV | M/Mo | dM/dV | M/Mo | dM/dV | M/Mo |
| HIGH CONCENTRATION | | | | | | | |
| | high rpm | | | | | | |
| high temperature | | | | | | | |
| | low rpm | | | | | | |
| | high rpm | | | | | | |
| medium temperature | | | | | | | |
| | low rpm | | | | | | |
| | high rpm | | | | | | |
| low temperature | | | | | | | |
| | low rpm | | | | | | |
| MED. CONCENTRATION | | | | | 20/.75 | | 2.6/.05 |
| | high rpm | | | 5.3 | 27 5 | .33 | 53 8 |
| high temperature | | | | | 22/.19 | | 3.4/.01 |
| | low rpm | | | 9 | 116 5 | .53 | 428 8 |
| | high rpm | | | | | | |
| medium temperature | | | | | | | |
| | low rpm | | | | | | |
| | | | | | 51/2.6 | | .32/.32 |
| | high rpm | | | 12 | 20 6 | 0 | 1 8 |
| low temperature | | | | | 22/.12 | | .16/.16 |
| | low rpm | | | 4 | 183 6 | 0 | 1 8 |
| LOW CONCENTRATION | | | 8.8/.64 | | | | |
| | high rpm | 5.9 | 14 2 | | | | |
| high temperature | | | 18/.025 | | | | |
| | low rpm | 4 | 720 6 | | | | |
| | high rpm | | | | | | |
| medium temperature | | | | | | | |
| | low rpm | | | | | | |
| | high rpm | N/A | N/A | | | | |
| low temperature | | | 3/.52 | | | | |
| | low rpm | .85 | 5.8 4 | | | | |

The improved electric field dependent fluids according to the present invention can be used in any electroviscous or electrorheological application as generally known in the art. The electric field dependent fluid of the present invention can be used as alternatives to friction clutches and torque converters for coupling engines or motors to transmissions or other types of machinery, for values and solenoids, in shock absorbers and as alternatives to friction brakes. As torque transfer media, the fluids have the distinct advantages of being able to control speed without varying the speed of the engine; being electrically controlled, they allow the direction control of torque transfer or speed by computers. As braking media, they eliminate problems with uneven braking and brake lock-up by again allowing computers to control the extent of braking at separate wheels. In torque transmission from turbine engine, speed can be varied while allowing the turbine to continue operating at optimum power and efficient rpm. The compositions of the present invention are viewed as being particularly useful in that they are stable and operable at temperature well over 100 ° C. and at least as high as 120 ° C. or even higher. They have also been shown to be operable at these high temperatures under high shear rates.

Having thus described and exemplified the preferred embodiments with a certain degree of particularity, it is to be understood that the invention is not to be limited by the embodiments set forth herein for purposes of exemplification, but is to be limited only by the scope of the attached claims, including a full range of equivalents to which each element thereof is entitled.

We claim:

1. A method of inducing a change in dynamic torque transmission of an electrorheological fluid in response to an electric field at low current comprising the steps of:

(a) selecting a nonconductive liquid phase;

(b) dispersing in said nonconductive liquid phase a particulate phase substantially free of adsorbed water, thus producing an electrorheological fluid; and (c) subjecting said electrorheological fluid prepared in step (b) to an electric potential in excess of about one kilovolt at a current density of less than about $\frac{1}{3}$ microamp per square inch.

2. A method of claim 1 wherein the rate of increase of the dynamic transmission of torque per unit voltage, dM/dV, is in excess of about 0.034 ft-lbs$\times 10^{-3}$/kV.

3. A method of claim 1 wherein the ratio of the dynamic transmission of torque at an electric field strength of at least 2.4 kV to the dynamic transmission of torque at zero field strength, M/Mo, is at least about 2.

4. A method of claim 1 wherein the increase in dynamic transmission of torque is reversed by the further step of decreasing the electric field potential.

5. A method of claim 1 wherein said particulate phase is an inorganic zeolite.

6. A method of claim 1 wherein said particulate phase is a crystalline zeolite characterized by the formula:

$$M_{(x/n)}[(AlO_2)_x(SiO_2)\cdot wH_2O$$

where M is a metal cation or mixture of metal cations of average valence charge n, x and y are integers and the ratio of y to x is from about 1 to about 5, and w is a variable.

7. A method of claim 6 wherein said crystalline zeolite is present from about 500 grams per liter of liquid to about 900 grams per liter of liquid and the rate of increase in dynamic transmission of torque per unit voltage, dM/dV, is from about 0.034 ft-lbs$\times 10^{-3}$/kV to about 8.4 ft-lbs$\times 10^{-3}$/kV.

8. A method of claim 1 wherein said increase in dynamic transmission of torque is achieved at temperatures from about 40° C. to about 120° C. without releasing significant amounts of water.

9. A method of inducing a change in dynamic torque transmission of an electrorheological fluid in response to an electric field at low current comprising the steps of:

(a) selecting a nonconductive liquid phase;

(b) dispersing in said non-conductive liquid phase an organic polymeric polyelectrolyte particulate phase substantially free of adsorbed water, thus producing an electrorheological fluid; and (c) subjecting said electrorheological fluid prepared in step (b) to an electric potential in excess of about one kilovolt at a current density of less than about $\frac{1}{3}$ microamp per square inch.

10. A method of inducing a change in dynamic torque transmission of an electrorheological fluid in response to an electric field at low current comprising the steps of:

(a) selecting a nonconductive liquid phase;

(b) dispersing in said nonconductive liquid phase a particulate phase substantially free of adsorbed water selected from the group consisting of polymeric cation exchange resin, polymeric anion exchange resin, and resinous polyelectrolyte, thus producing an electrorheological fluid; and (c) subjecting said electrorheological fluid prepared in step (b) to an electric potential in excess of about one kilovolt at a current density of less than about $\frac{1}{3}$ microamp per square inch.

11. A method of claim 8 wherein said particulate phase is present from about 500 grams per liter of liquid to about 900 grams per liter of liquid and the rate of increase in dynamic transmission of torque per unit voltage, dM/dV, is up to about 1.2 ft-lbs$\times 10^{-3}$/kV.

12. A method of claim 6 wherein said electrorheological fluid contains less than 5% by weight zeolite water.

13. An electric field dependent fluid comprising:

(a) a nonconductive liquid phase; and (b) a dispersed particulate organic polymeric polyelectrolyte phase, substantially free of adsorbed water.

14. An electric field dependent fluid of claim 13 selected from the group consisting of cation exchange resin, anion exchange resin, and resinous polyelectrolyte.

15. An electric field dependent fluid of claim 13 wherein said fluid exhibits significant viscosity dependence upon an imposed electric field at temperatures in excess of 100 ° C. without releasing significant amounts of water.

16. A method of preparing a field dependent fluid adapted to be operative at a temperature range of from at least about 40 ° C. to at least about 100 ° C. without the release of water, comprising the steps of:

(a) selecting a nonconductive liquid of said field dependent fluid;

(b) selecting an organic polymeric polyelectrolyte as the particulate phase of said field dependent fluid; and (c) subjecting said nonconductive liquid and said organic polymeric polyelectrolyte to a temperature in excess of the temperature to which the field dependent fluid will be subjected to during use for a sufficient time to degas and remote water.

* * * * *